US010814647B2

(12) United States Patent
Kondo et al.

(10) Patent No.: US 10,814,647 B2
(45) Date of Patent: Oct. 27, 2020

(54) MEDIUM DISCHARGING DEVICE

(71) Applicant: SEIKO EPSON CORPORATION, Tokyo (JP)

(72) Inventors: Katsuyuki Kondo, Nagano (JP); Masayoshi Miyakawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/172,912

(22) Filed: Oct. 29, 2018

(65) Prior Publication Data

US 2019/0126641 A1 May 2, 2019

(30) Foreign Application Priority Data

Oct. 30, 2017 (JP) ..... 2017-209130

(51) Int. Cl.

| | |
|---|---|
| ***B41J 11/06*** | (2006.01) |
| ***B41J 11/00*** | (2006.01) |
| ***B65H 29/70*** | (2006.01) |
| ***B41J 13/10*** | (2006.01) |
| ***B65H 29/52*** | (2006.01) |
| ***B65H 31/26*** | (2006.01) |
| ***B65H 29/14*** | (2006.01) |

(Continued)

(52) U.S. Cl.

CPC ..... *B41J 11/0005* (2013.01); *B41J 13/106* (2013.01); *B65H 29/125* (2013.01); *B65H 29/14* (2013.01); *B65H 29/52* (2013.01); *B65H 29/70* (2013.01); *B65H 31/10* (2013.01); *B65H 31/26* (2013.01); *B65H 31/3027* (2013.01); *B65H 2301/33312* (2013.01); *B65H 2301/51214* (2013.01); *B65H 2404/1416* (2013.01); *B65H 2404/531* (2013.01); *B65H 2404/61* (2013.01); *B65H 2404/68* (2013.01); *B65H 2404/693* (2013.01); *B65H 2405/11151* (2013.01); *B65H 2511/20* (2013.01); *B65H 2511/51* (2013.01); *B65H 2701/1311* (2013.01); *B65H 2701/1313* (2013.01); *B65H 2701/18292* (2013.01); *B65H 2801/06* (2013.01); *B65H 2801/27* (2013.01)

(58) Field of Classification Search

None

See application file for complete search history.

(56) References Cited

U.S. PATENT DOCUMENTS

| | | | | |
|---|---|---|---|---|
| 8,955,838 | B2 | 2/2015 | Saito et al. | |
| 2004/0160503 | A1* | 8/2004 | Guerrero Zepeda | .. B41J 13/106 347/104 |

(Continued)

FOREIGN PATENT DOCUMENTS

| | | | |
|---|---|---|---|
| CN | 103723552 | A | 4/2014 |
| JP | 07-300270 | A | 11/1995 |

(Continued)

*Primary Examiner* — Erica S Lin

(74) *Attorney, Agent, or Firm* — Global IP Counselors, LLP

(57) ABSTRACT

A medium discharging device includes a paper discharging tray that is disposed below a height position of a discharging roller which discharges a medium and includes a placing surface on which the medium discharged by the discharging roller is placed, and a supporting member that is configured to be movable between a retreat position on an upstream side and an advance position on a downstream side between the discharging roller and the placing surface.

16 Claims, 13 Drawing Sheets

(51) Int. Cl.

| | |
|---|---|
| ***B65H 31/30*** | (2006.01) |
| ***B65H 31/10*** | (2006.01) |
| ***B65H 29/12*** | (2006.01) |

(56) References Cited

U.S. PATENT DOCUMENTS

| | | | | |
|---|---|---|---|---|
| 2013/0002750 | A1* | 1/2013 | Takenouchi | B41J 29/38<br>347/16 |
| 2014/0103604 | A1 | 4/2014 | Saito et al. | |
| 2014/0292978 | A1* | 10/2014 | Kodama | B41J 11/0005<br>347/104 |

FOREIGN PATENT DOCUMENTS

| | | | |
|---|---|---|---|
| JP | H11-193156 | A | 7/1999 |
| JP | 2002-154726 | A | 5/2002 |
| JP | 2004-002039 | A | 1/2004 |
| JP | 2014-196182 | A | 10/2014 |
| JP | 2016-088658 | A | 5/2016 |

* cited by examiner

MEDIUM DISCHARGING DEVICE

CROSS REFERENCES TO RELATED APPLICATIONS

The entire disclosure of Japanese Patent Application No. 2017-209130, filed Oct. 30, 2017 is expressly incorporated by reference herein.

BACKGROUND

1. Technical Field

The present disclosure relates to a medium discharging device.

2. Related Art

In the related art, an ink jet type recording apparatus which performs a recording process (printing) by ejecting ink to a recording medium from a nozzle of a liquid discharging unit is proposed and commercialized. When the recording process is performed using such a recording apparatus, a recorded surface of the recording medium absorbs ink so as to expand, and when the recording medium on which the recording process is executed is discharged by a discharging roller and is placed on a paper discharging tray, there is a case in which the recording medium may be curled so that a surface (surface to which ink is not discharged) opposite to the recorded surface is recessed.

In order to deal with such a problem, a technique, in which a member for bending a recording medium by displacing both end portions of the recording medium in a width direction to be closer to a lower side than a center portion in a vertical direction and a member for holding a bent state thereof are provided in a discharging unit that discharges the recording medium on which the recording process is executed, is proposed (for example, refer to JP-A-2014-196182). If such a technique is adopted, it is possible to control curling of the recording medium on the paper discharging tray and to improve stacking properties.

However, when the recording process is continuously performed on a plurality of sheets of the recording medium using the ink jet type recording apparatus, there is a case in which a downstream end of recording media (succeeding media) subsequent to a second sheet of the recording media in a transporting direction may abut an upper surface of a recording medium (preceding medium) precedently placed on the paper discharging tray, and the downstream end of the succeeding medium may be curved downward. Particularly, in recent years, a problem also occurs in that a downstream end of the medium bundle succeedingly discharged abuts an upper surface of the medium bundle precedently placed on the paper discharging tray so as to be curved as a post-processing device which creates a medium bundle by performing a stapling process or the like on a plurality of recording media is used. Such a problem is not considered in the related art disclosed in JP-A-2014-196182, and thus an effective countermeasure has been expected.

SUMMARY

An advantage of some aspects of the disclosure is to provide a medium discharging device which is capable of suppressing that a downstream end of a succeeding medium in a transporting direction abuts an upper surface of a preceding medium on a paper discharging tray so as to be curved.

According to an aspect of the disclosure, there is provided a medium discharging device including a discharging roller that is discharging a medium, a paper discharging tray that is disposed below a height position of the discharging roller and includes a placing surface on which the medium discharged by the discharging roller is placed, and a supporting member that is configured to be movable between a retreat position on an upstream side and an advance position on a downstream side in a medium discharging direction between the discharging roller and the placing surface, in which a friction coefficient of an upper surface of the supporting member is equal to or lower than a friction coefficient of the placing surface, and a position of a downstream end of the supporting member in the medium discharging direction at the advance position is disposed on a downstream side in the medium discharging direction of a position where the downstream end of the medium being discharged in the medium discharging direction in a case in which the supporting member is not present primally comes into contact with an upper surface of the medium precedently placed on the placing surface.

In the configuration, since the supporting member is configured to be advanceable and retreatable between the retreat position on the upstream side and the advance position on the downstream side in the medium discharging direction in the space between the discharging roller and the placing surface of the paper discharging tray, the friction coefficient of the upper surface of the supporting member is equal to or lower than the friction coefficient of the placing surface, the position of the downstream end of the supporting member at the advance position is disposed on the downstream side of the position where the downstream end of the medium (succeeding medium) being discharged in a case in which the supporting member is not present primally comes into contact with the upper surface of the preceding medium (the medium precedently placed on the placing surface of the paper discharging tray), the downstream end of the succeeding medium is capable of preferentially coming into contact with the upper surface of the supporting member having a relatively low friction coefficient before the upper surface of the preceding medium. Accordingly, it is possible to prevent that the downstream end of the succeeding medium abuts the upper surface of the preceding medium so as to be curved downward.

In the medium discharging device, an angle between the downstream end of the medium being discharged in a case in which the supporting member is disposed at the advance position and the supporting member at a position where the downstream end primally abuts the upper surface of the supporting member at the advance position may be smaller than an angle between the downstream end of the medium being discharged in a case in which the supporting member is not present at the advance position and the upper surface of the placed medium at a position where the downstream end primally abuts the upper surface of the medium precedently placed on the placing surface.

In the configuration, since the angle between the downstream end of the discharged medium (succeeding medium) and the upper surface of the supporting member at the advance position is smaller than the angle between the downstream end of the medium (succeeding medium) discharged in a case in which the supporting member is not present and the upper surface of the preceding medium (the medium precedently placed on the placing surface of the paper discharging tray), the downstream end of the succeeding medium is capable of coming into contact with the upper surface of the supporting member at an acute angle as compared to a case in which the downstream end thereof comes into contact with the upper surface of the preceding medium. Accordingly, it is possible to more effectively prevent the downstream end of the succeeding medium from being curved downward.

In the medium discharging device, the supporting member may advance to the advance position when the downstream end of the medium being discharged by the discharging roller is discharged. In addition, a medium detector that detects the medium being discharged may be further included on a downstream of the discharging roller, and the supporting member may advance to the advance position after the downstream end of the discharged medium is detected by the medium detector. In addition, the supporting member may advance to the advance position after the downstream end of the discharged medium is detected by the medium detector and before the downstream end of the discharged medium comes into contact with an upper surface of the supporting member.

In the medium discharging device, a position of the downstream end of the supporting member at the retreat position may be disposed on an upstream side in the medium discharging direction of a position of an upstream end of the medium in the medium discharging direction which is discharged and dropped to the paper discharging tray.

In the configuration, since the position of the downstream end of the supporting member at the retreat position is disposed above the upstream end of the medium which is discharged and dropped to the paper discharging tray, dropping of the medium to the paper discharging tray does not interfere with the supporting member.

In the medium discharging device, the supporting member may retreat to the retreat position when the upstream end of the medium discharged by the discharging roller is discharged. In addition, a medium detector that detects the medium being discharged may be further included on a downstream of the discharging roller, and the supporting member may retreat to the retreat position after the upstream end of the discharged medium is detected by the medium detector. In addition, the supporting member may retreat to the retreat position after the upstream end of the discharged medium is detected by the medium detector and before the discharged medium is dropped to the placing surface. In addition, the supporting member may retreat to the retreat position after the downstream end of the discharged medium starts to move to the downstream side in the medium discharging direction on the supporting member and before the discharged medium is dropped to the placing surface.

In the medium discharging device, the medium being discharged may be a medium bundle in which a plurality of media is bound. In the configuration, the discharging roller is capable of discharging the medium bundle.

In the medium discharging device, it is possible to dispose the plurality of the supporting members in the width direction of the medium. In the configuration, the height position in the vertical direction where the supporting member disposed near the center of the medium in the width direction advances and retreats can be disposed above the height position in a vertical direction where the supporting member disposed near an end portion in the width direction of the medium advances and retreats.

In the configuration, since the height position in the vertical direction where the supporting member disposed near the center of the medium in the width direction advances and retreats is disposed on an upper side in the vertical direction than the height position in the vertical direction where the supporting member disposed near the end portion in the width direction of the medium advances and retreats, even in a case in which a part near the end portion in the width direction of the medium on which printing is executed is bent so as to be risen, such bending thereof can be suppressed, and contact of the succeeding medium with the part near the end portion of the preceding medium in the width direction can be suppressed.

In the medium discharging device, the supporting member may be a sheet member having a sheet shape, and a width of the supporting member disposed near the center of the medium in the width direction may be wider than a width of the supporting member disposed near the end portion of the medium. In addition, the supporting member may be a sheet member having a sheet shape, and a thickness of the supporting member disposed near the center of the medium in the width direction may be thicker than a thickness of the supporting member disposed near the end portion of the medium.

In the configuration, since the width of the supporting member disposed near the center of the medium in the width direction is widen (a thickness thereof is thickened), the center portion of the medium in the width direction can be supported with relatively high strength, and thereby it is possible to more effectively prevent the downstream end of the medium from being curved downward.

In the medium discharging device, a medium surface detector that detects a position of an upper surface of the medium placed may be further included on the placing surface, and the paper discharging tray is lifted based on the position of the upper surface of the medium detected by the medium surface detector so that the downstream end of the supporting member at the advance position may be positioned above the upper surface of the medium placed on the placing surface.

In the configuration, for example, even in a case in which a plurality of the media is piled on the placing surface of the paper discharging tray, the downstream end of the supporting member at the advance position can be positioned always above the upper surface of the medium placed on the placing surface when the paper discharging tray is lowered based on a position of the upper surface of the medium.

In the medium discharging device, a device which discharges the medium from the processing device discharging liquid to the medium may be adopted. In the configuration, it is possible to advance the supporting member to the advance position in a case in which the amount of the liquid discharged to the medium is equal to or more than a predetermined amount.

According to another aspect of the disclosure, there is provided a medium discharging device including a discharging roller that is discharging a medium, a paper discharging tray that is disposed below a height position of the discharging roller in a vertical direction and includes a placing surface on which the medium discharged by the discharging roller is placed, and a supporting member that is configured to be movable between a retreat position on an upstream side and an advance position on a downstream side in a medium discharging direction in a space between the discharging roller and the placing surface, in which a friction coefficient of an upper surface of the supporting member is equal to or lower than a friction coefficient of the placing surface, and an angle between a downstream end in the medium discharging direction of the discharged medium and the upper surface of the supporting member at the advance position is smaller than an angle between the downstream end of the discharged medium in a case in which the supporting member is not present and the upper surface of the medium precedently placed on the placing surface.

In the configuration, since the supporting member is configured to be advanceable and retreatable between the retreat position on the upstream side and the advance position on the downstream side in the medium discharging direction in the space between the discharging roller and the placing surface of the paper discharging tray, the friction coefficient of the upper surface of the supporting member is equal to or lower than the friction coefficient of the placing surface, and the angle between the downstream end of the discharged medium (succeeding medium) and the upper surface of the supporting member at the advance position is smaller than the angle between the downstream end of the medium (succeeding medium) discharged in a case in which the supporting member is not present and the upper surface of the preceding medium (the medium precedently placed on the placing surface the paper discharging tray), the downstream end is capable of coming into contact with the upper surface of the supporting member at the acute angle as compared to a case in which the downstream end of the succeeding medium comes into contact with the upper surface of the preceding medium. Accordingly, since friction can be relaxed as compared to a case in which the downstream end of the succeeding medium comes into contact with the upper surface of the preceding medium, it is possible to prevent the downstream end of the succeeding medium from being curved downward.

BRIEF DESCRIPTION OF THE DRAWINGS

The disclosure will be described with reference to the accompanying drawings, wherein like numbers reference like elements.

(FIG. 12A is a view illustrating before an exchanging cover is taken out, FIG. 12B is a view illustrating a state in which the exchanging cover is taken out, and FIG. 12C is a view illustrating a state in which the sheet member is taken out).

DESCRIPTION OF EXEMPLARY EMBODIMENTS

Hereinafter, an embodiment of a printing apparatus according to an embodiment of the disclosure will be described with reference to drawings. Also, the disclosure is not limited to the embodiment.

First, a configuration of a printing apparatus 1 according to an embodiment will be described.

Figure 1:
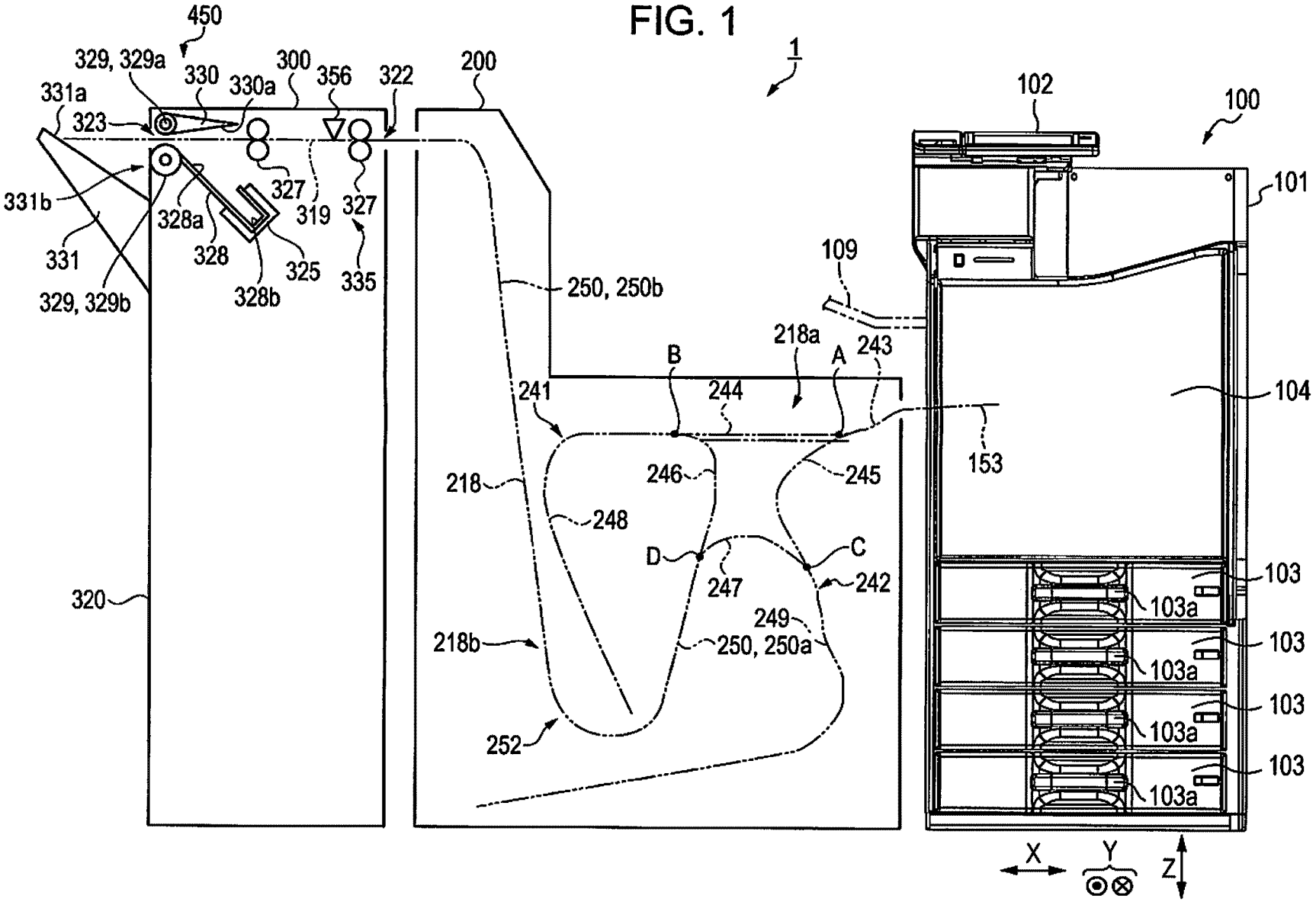
FIG. 1 is a schematic diagram illustrating a configuration of a printing apparatus.

As illustrated in FIG. 1, the printing apparatus 1 includes an image forming device 100, an intermediate transporting device 200, and a post-processing device 300. In addition, the printing apparatus 1 includes a controller 10 (refer to FIG. 13) that generally controls driving of each mechanism. The image forming device 100 is a device that forms an image on paper M (refer to FIG. 2) as a medium and corresponds to a processing device in the disclosure. The post-processing device 300 is a device that performs a post-process such as a stapler process in which a plurality of paper M on which an image is formed is bound by a staple (needle) and corresponds to a medium discharging device in the disclosure. Also, the intermediate transporting device 200 is a device that transports the paper M on which an image is formed by the image forming device 100 to the post-processing device 300. The intermediate transporting device 200 is a device disposed between the image forming device 100 and the post-processing device 300.

In the printing apparatus 1 of the embodiment, a third discharging path 153 as an upstream side transporting path of the image forming device 100 is connected to an intermediate transporting path 218 of the intermediate transporting device 200, and the intermediate transporting path 218 is connected to a downstream side transporting path 319 of the post-processing device 300. Also, the third discharging path 153, the intermediate transporting path 218, and the downstream side transporting path 319 constitute a transporting path (two-dot chain line in FIG. 1) continued from the image forming device 100 to the post-processing device 300 through the intermediate transporting device 200, which are an upstream side of the paper M in a transporting direction.

As illustrated in FIG. 1, the image forming device 100 includes a substantially rectangular parallelepiped recording apparatus side case 101 which is an ink jet printer recording images such as characters, figures, or photos by attaching ink as an example of liquid to the paper M as an example of a medium. An operating unit 102 for performing various operations of the image forming device 100 is attached to an upper portion of the recording apparatus side case 101.

In the image forming device 100, in a vertical direction Z, a paper cassette 103 is provided from a center portion to a lower portion of the image forming device 100. In the embodiment, four paper cassettes 103 are arranged in the vertical direction Z. The paper M to be recorded by the image forming device 100 is accommodated in each paper cassette 103 in a stacked state. In addition, a gripping part 103*a* that a user can grip is formed in each paper cassette 103. Also, the paper cassette 103 is configured to be detachable from the recording apparatus side case 101. Also, the paper M being accommodated in each paper cassette 103 may be different types from one another or may be the same type.

A rectangular shaped front plate cover 104 is provided above the paper cassette 103 on an uppermost end in the vertical direction Z. The front plate cover 104 is provided to be rotatable with a long side adjacent to the paper cassette 103 as a base end, and is configured to be rotatable between two positions of an opened position where a distal end side which becomes an opposite side of the base end is separated from the image forming device 100 and a closed position constituting a part of the recording apparatus side case 101.

Figure 2:
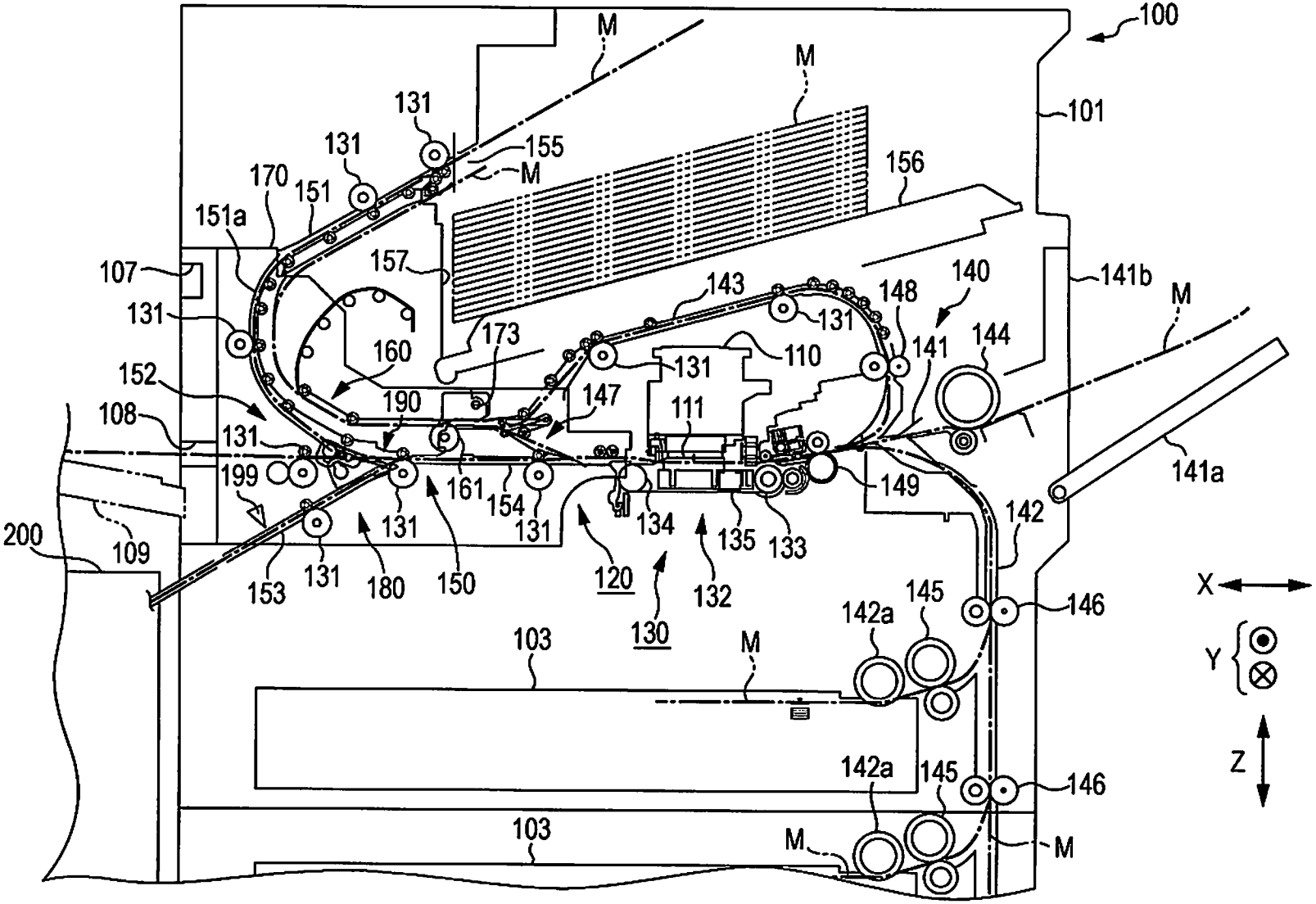
FIG. 2 is a configuration view illustrating a configuration of an image forming device.

In addition, as illustrated in FIG. 2, a discharging port 108 through which the paper M is discharged is formed on a part of an intermediate transporting device 200 side of the recording apparatus side case 101. Also, the paper discharging tray 109 extending from the recording apparatus side case 101 to the intermediate transporting device 200 side is further provided to be attachable to a lower side of the discharging port 108 as needed. That is, the paper M discharged from the discharging port 108 is placed on the paper discharging tray 109. Also, the paper discharging tray 109 is configured to be detachable from the recording apparatus side case 101, and includes a rising gradient (left upper side in FIG. 2) upwardly inclined from the base end connected to the recording apparatus side case 101 toward a distal end which becomes an opposite side of the base end.

As illustrated in FIG. 2, inside the recording apparatus side case 101 included in the image forming device 100, a recording unit 110 that performs recording on the paper M from an upper side in the vertical direction Z, and a transporting unit 130 that transports the paper M along a transporting path 120 inside the apparatus are provided. The transporting path 120 inside the apparatus is formed so that the paper M is transported when a direction along a front and rear direction Y is set to a width direction of the paper M and a direction intersecting the width direction is set to the transporting direction.

The recording unit 110 includes a line head type recording head 111 capable of discharging ink at the same time to the substantial entire area of the paper M in the width direction. The recording unit 110 forms an image on the paper M when ink being discharged from the recording head 111 is attached to a recorded surface (surface on which an image is printed) in the paper M facing the recording head 111.

Also, in the image forming device 100 in the embodiment, the discharged amount sensor 112 (refer to FIG. 13) detecting an amount (discharged amount) of ink discharged to the paper M is provided. A signal of a detected result by the discharged amount sensor 112 is sent to the controller 10 (refer to FIG. 13) and is used for an advance and retreat control of a sheet member 340 of the post-processing device 300 to be described later. Specifically, the controller 10 controls a tractor unit 360 (refer to FIGS. 10 and 11) to be described later so as to proceed the sheet member 340 to a "advance position" only in a case in which a discharged amount detected by the discharged amount sensor 112 is equal to or more than a predetermined amount.

The transporting unit 130 includes a plurality of pairs of transporting rollers 131, which are disposed along the transporting path 120 inside the apparatus and is driven by a transportation driving motor (not illustrated), and a belt transporting unit 132 provided right below the recording unit 110. That is, ink is discharged from the recording head 111 on the paper M being transported by the belt transporting unit 132, and thus recording is performed.

The belt transporting unit 132 includes a driving roller 133 which is disposed on an upstream side of the recording head 111 in the transporting direction, a driven roller 134 which is disposed on a downstream side of the recording head 111 in the transporting direction, and an endless type annular belt 135 hung on each of rollers 133 and 134. The belt 135 is rotated by rotary-driving the driving roller 133, and the paper M is transported to a downstream side by the rotated belt 135. That is, an outer circumferential surface of the belt 135 functions as a supporting surface supporting the paper M on which recording is performed.

The transporting path 120 inside the apparatus includes a supply path 140 through which the paper M is transported toward the recording unit 110, a discharging path 150 through which the paper M being recorded by the recording unit 110 and finished to be recorded is transported, and a branch path 160 branched by a branch mechanism 147.

The supply path 140 includes a first supply path 141, a second supply path 142, and a third supply path 143. In the first supply path 141, the paper M, which is inserted from an inserting port 141*b* exposed by opening a cover 141*a* provided on a right side surface of the recording apparatus side case 101, is transported to the recording unit 110. That is, the paper M inserted from the inserting port 141*b* is linearly transported to the recording unit 110 by rotary-driving a pair of first driving rollers 144.

In the second supply path 142, in the vertical direction Z, the paper M, which is respectively accommodated in the paper cassette 103 provided on a lower portion of the recording apparatus side case 101, is transported to the recording unit 110. That is, regarding the paper M which is accommodated in the paper cassette 103 in a stacked state, after the uppermost paper M is sent by a pick-up roller 142*a* and the paper is separated one by one by a pair of separating rollers 145, a posture of the paper is reversed in the vertical direction Z, and then the paper is transported toward the recording unit 110 by rotary-driving a pair of second driving rollers 146.

In the third supply path 143, in a case in which double-side printing of recording an image on both surfaces of the paper M is performed, the paper M in which one surface is recorded by the recording unit 110 is transported again to the recording unit 110. That is, the branch path 160 branched from the discharging path 150 is provided on a downstream side of the recording unit 110 in the transporting direction. That is, at the time of performing the double-side printing, the paper M is transported to the branch path 160 by an operation of the branch mechanism 147 provided in the middle of the discharging path 150. In addition, in the branch path 160, a pair of branch path rollers 161 which is rotatable in both directions of forward and reverse directions is provided on a downstream side of the branch mechanism 147.

At the time of performing the double-side printing, the paper M in which one surface is printed is temporarily guided to the branch path 160 by the branch mechanism 147, and is transported to a downstream side inside the branch path 160 by the pair of branch path rollers 161 which is forwardly rotated. Then, the paper M transported to the branch path 160 is reversely transported from the downstream side to an upstream side inside the branch path 160 by the pair of branch path rollers 161 which is reversely rotated. That is, a transportation direction of the paper M to be transported in the branch path 160 is reversed.

The paper M reversely transported from the branch path 160 is transported to the third supply path 143, and is transported toward the recording unit 110 by a plurality of the pairs of transporting rollers 131. When the paper M is transported in the third supply path 143, the paper is reversed, such that the other surface thereof which is not printed faces the recording unit 110, and is transported toward the recording unit 110 by rotary-driving a pair of third driving rollers 148. That is, the third supply path 143 functions as a reverse transporting path where the paper M is transported while a posture of the paper in the vertical direction Z is reversed.

Among the supply paths 141, 142, and 143, through the second supply path 142 and the third supply path 143, the paper M is transported toward the recording unit 110 while the posture of the paper M in the vertical direction Z is bent. Meanwhile, in the first supply path 141, the posture of the paper M is not significantly bent as compared to the second supply path 142 and the third supply path 143, and the paper M is transported toward the recording unit 110.

The paper M, which is transported through each of the supply paths 141, 142, and 143, is transported to reach a pair of aligning rollers 149 disposed on an upstream side of the recording unit 110 in the transporting direction, and then a leading edge thereof is bumped to the pair of aligning rollers 149 which is stopped to be rotated. Also, inclination of the paper M with respect to the transporting direction is corrected (skewed) in a state of being bumped to the pair of aligning rollers 149. Also, the paper M in which the inclination is corrected is transported to the recording unit 110 in an aligned state by rotary-driving the pair of aligning rollers 149 after that.

The paper M, in which recording is performed on one surface or both surfaces by the recording unit 110 and recording is completed, is transported by the pairs of transporting rollers 131 along the discharging path 150 constituting a downstream portion of the transporting path 120 inside the apparatus. The discharging path 150 is branched to a first discharging path 151, a second discharging path 152, and a third discharging path 153 at a position below a position where the branch path 160 is branched. That is, the paper M in which recording is completed is transported to a common discharging path (upstream discharging path) 154 constituting an upstream portion of the discharging path 150, and then is guided by a guiding mechanism (switch guiding unit) 180, which is provided on a downstream end of the common discharging path 154, to any one path of the first to third discharging paths 151, 152, and 153 constituting a downstream portion of the discharging path 150.

The first discharging path (upper side discharging path) 151 is disposed toward an upper side of the recording apparatus side case 101 and is provided to be bent along the branch path 160 and extends. The paper M being transported to the first discharging path 151 is discharged from the discharging port 155 which is opened to a part of the recording apparatus side case 101 so as to become an end of the first discharging path 151. Also, the paper M discharged from the discharging port 155 is dropped to a lower side in the vertical direction Z and is discharged to a placing board 156 in a stacked state as illustrated by a two-dot chain line in FIG. 2. Also, the paper M is discharged to the placing board 156 from the discharging port 155 by the pairs of transporting rollers 131, which are disposed at a plurality of places in the discharging path 150, in a posture in which the recorded surface is positioned downward in the vertical direction Z at the time of one-side printing.

The placing board 156 has an upwardly inclined shape which is risen upward in the vertical direction Z as the shape toward a right direction in a horizontal direction X, and the paper M is placed on the placing board 156 in a stacked state. At this time, each paper M placed on the placing board 156 moves in a left direction along the inclination of the placing board 156, and approaches a vertical side wall 157 which is provided on a lower side of the discharging port 155 of the recording apparatus side case 101 so as to be placed thereon.

In addition, the first discharging path 151 includes a bending and reversing path 151*a* where front and rear of the paper M are reversed while the paper M recorded by the recording unit 110 is transported to the discharging port 155. That is, the bending and reversing path 151*a* bends the paper M recorded by the recording unit 110 so as to set the recorded surface to an inner side of the paper, and reverses the paper M from a state, in which the recorded surface of the paper M in the vertical direction Z is disposed toward an upper side in the vertical direction Z, to a state, in which the recorded surface thereof is disposed toward a lower side in the vertical direction Z. Therefore, in the discharging path 150, the paper M passes through the bending and reversing path 151*a*, the recorded surface thereof faces the placing board 156 at the time of single-side printing, and thus the paper is discharged from the discharging port 155.

The second discharging path 152 is branched to a lower side of the first discharging path 151 in the vertical direction Z, and linearly (horizontally) extends toward the intermediate transporting device 200 from the recording unit 110. Therefore, the paper M being transported to the second discharging path 152 is not transported in a state of being bent as in the first discharging path 151 and is linearly transported while being constantly maintained in the same manner when the posture thereof passes through the recording unit 110, such that the paper is discharged toward the paper discharging tray 109 from the discharging port 108. That is, the second discharging path 152 functions as a non-reverse discharging path where the paper M is transported toward the paper discharging tray 109 without reversing the posture of the paper M.

The third discharging path 153 is branched to a lower side of the second discharging path 152 in the vertical direction Z, and extends obliquely downward in the vertical direction Z toward a lower side of the recording apparatus side case 101. Also, the downstream end thereof is connected to the intermediate transporting path 218 included in the intermediate transporting device 200. That is, the paper M being transported to the third discharging path 153 is discharged to the intermediate transporting device 200. Also, in the third discharging path 153, a transportation detecting unit 199 which is capable of detecting presence and absence of the paper M is provided. The transportation detecting unit 199 is, for example, a light transmission type or light reflection type photo-interrupter, and includes a light emitting unit emitting light and a light receiving unit receiving light emitted from the light emitting unit. As a light emitting element of the light emitting unit, for example, a light emitting diode (LED) light emitting element, a laser light emitting element, or the like is applied. In addition, the light receiving unit is constituted by a phototransistor, a photo IC, or the like. It is possible to detect presence and absence (turning on and off of light receiving unit for receiving light) of the paper M by the light emitting unit and the light receiving unit.

The transportation detecting unit 199 is connected to the controller 10 (refer to FIG. 13) and is controlled to be driven based on a predetermined program. The controller 10 drives the transportation detecting unit 199, compares a received amount or the like in the light receiving unit and a threshold set in advance with each other, and detects the presence and absence of the paper M. Also, in synchronization with driving of the pairs of transporting rollers 131, in a case in which the presence and absence of the paper M is repeatedly detected, the paper M is determined to be in a general transporting state. Meanwhile, at a predetermined timing or within a predetermined time, in a case in which a state, in which the received amount of light in the light receiving unit is not present, is continued, it is determined that there is an abnormal state (jam). For example, when a transportation defect of the paper M occurs, in a case in which the paper M is not normally transported from the recording head 111 side, it is determined that there is an abnormal state (jam).

A part of the discharging path 150 and a part of the branch path 160 are attached to a drawing unit 170 provided on the recording apparatus side case 101. Also, the drawing unit 170 is configured to be detachable from the recording apparatus side case 101.

Here, the paper M which can be applied to the printing apparatus 1 is preferably paper having hygroscopicity and flexibility, and for example, normal paper such as electrophotographic copying paper, and ink jet paper including a water-soluble ink absorbing layer containing silica, alumina, polyvinyl alcohol (PVA), polyvinylpyrrolidone (PVP), and the like are exemplified. In addition, as an absorptive recording medium which is a type of a medium in which a penetration speed of the water-soluble ink is relatively slow, art paper, coated paper, cast paper, and the like which are used for general offset printing are exemplified.

Next, the intermediate transporting device 200 will be described. As illustrated in FIG. 1, the intermediate transporting device 200 includes an intermediate transporting unit 252 capable of transporting the paper M. The intermediate transporting unit 252 includes at least one reversing unit (two of first reversing unit 241 and second reversing unit 242 in embodiment) which reverses the transported paper M. The first reversing unit 241 and the second reversing unit 242 are positioned below the transporting path of the recording unit 110 in the transporting direction, and reverse the paper M on which an image is formed (printed). In addition, the intermediate transporting device 200 includes the intermediate transporting path 218 through which the paper M is transported. Accordingly, the intermediate transporting device 200 has a dry function of drying the paper M on which an image is formed while the paper is transported in the image forming device 100 and a reverse function of reversing the transported paper M from the image forming device 100.

The intermediate transporting path 218 of the intermediate transporting device 200 is connected to the third discharging path 153 of the image forming device 100. In addition, the intermediate transporting path 218 includes an introduction path 243, in which an upstream end is connected to the third discharging path 153, and a first branch path 244 and a second branch path 245 branched at a branch point A on a downstream end of the introduction path 243. That is, at the branch point A, the downstream end of the introduction path 243, an upstream end of the first branch path 244, and an upstream end of the second branch path 245 are respectively connected. Also, path lengths of the first branch path 244 and the second branch path 245 in the transporting direction are substantially the same as each other.

Further, the intermediate transporting path 218 includes a first merging path 246 connected to a first connection point B on a downstream end of the first branch path 244 and a second merging path 247 connected to a second connection point C on a downstream end of the second branch path 245. Path lengths of the first merging path 246 and the second merging path 247 in the transporting direction are substantially the same as each other.

In addition, at the first connection point B, a first reversing path 248 included in the first reversing unit 241 is connected. In addition, at the second connection point C, a second reversing path 249 included in the second reversing unit 242 is connected. That is, at the first connection point B, the downstream end of the first branch path 244, an upstream end of the first merging path 246, and one end of the first reversing path 248 are connected. In addition, at the second connection point C, the downstream end of the second branch path 245, an upstream end of the second merging path 247, and one end of the second reversing path 249 are connected. Also, path lengths of the first reversing path 248 and the second reversing path 249 are constituted to be equal to or longer than a length of the paper M on which an image can be formed (printed) by the image forming device 100 in the transporting direction.

Further, in the intermediate transporting path 218, a merging point D where the first merging path 246 and the second merging path 247 are merged is provided, and a deriving path 250 connected to the merging point D is included. That is, at the merging point D, the downstream end of the first merging path 246, the downstream end of the second merging path 247, and an upstream end of the deriving path 250 are connected. The deriving path 250 extends downward between the first reversing path 248 and the second reversing path 249 toward the post-processing device 300, is rotated to wrap around the first reversing path 248, and then extends upward. Also, the deriving path 250 is constituted by a first deriving path **250*a* disposed on an upstream side and a second deriving path 250*b* disposed on a downstream side of the first deriving path 250*a*. Also, the downstream end of the second deriving path 250*b* is connected to the downstream side transporting path 319 of the post-processing device 300**.

Also, in the embodiment, the introduction path 243, the first branch path 244, and the second branch path 245 constitute a pre-reverse path **218*a*, and the first merging path 246, the second merging path 247, and the deriving path 250 constitute a post-reverse path 218*b*. Also, the pre-reverse path 218*a* is positioned on an upstream side of the first reversing unit 241 in the transporting direction or the second reversing unit 242 in the transporting direction. Further, the post-reverse path 218*b* is positioned on a downstream side in the transporting direction of the first reversing unit 241 or the second reversing unit 242 in the transporting direction. That is, the intermediate transporting path 218 includes the pre-reverse path 218*a* positioned on the upstream side in the transporting direction of the first reversing unit 241 and the second reversing unit 242 in the transporting direction and the post-reverse path 218*b*** positioned on the downstream side in the transporting direction.

Figure 3:
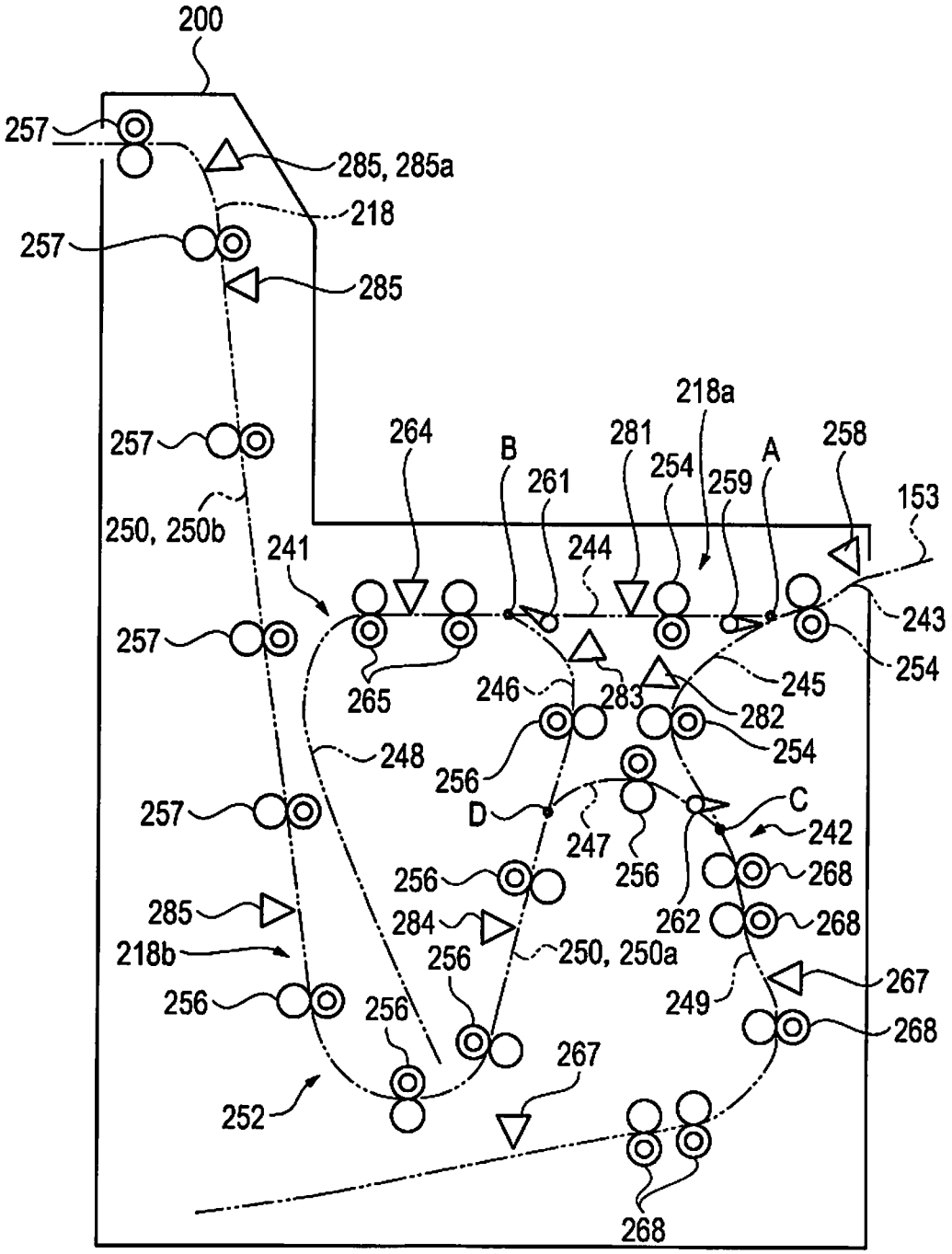
FIG. 3 is a configuration view illustrating a configuration of an intermediate transporting device.

In addition, as illustrated in FIG. 3, the intermediate transporting device 200 includes the intermediate transporting unit 252 capable of transporting the paper M along the intermediate transporting path 218. The first reversing unit 241 and the second reversing unit 242 in the intermediate transporting unit 252 are configured to be capable of reversing the paper M to be transported.

First pairs of transporting rollers 254 driven by a first driving motor (not illustrated) are disposed on the introduction path 243, the first branch path 244, and the second branch path 245. In addition, second pairs of transporting rollers 256 driven by a second driving motor (not illustrated) are disposed on the first merging path 246, the second merging path 247, and the first deriving path 250*a*. In addition, third pairs of transporting rollers 257 driven by a third driving motor (not illustrated) are disposed on the second deriving path 250*b*. Also, the number of the first pairs of transporting rollers 254, the second pairs of transporting rollers 256, and the third pairs of transporting rollers 257 can be set to a certain number depending on a form or the like of each transporting path. Also, when, in a state in which the respective roller pairs of the intermediate transporting unit 252 pinch the paper M from both front and rear sides so as to support the paper, and one of the pair of rollers among the pairs of rollers is rotary-driven, the paper M is transported along the transporting path.

In addition, in the introduction path 243, an introduction detecting unit 258 which detects the paper M is provided. The introduction detecting unit 258 is, for example, a photo interrupter, and a specific configuration thereof is the same as that of the transportation detecting unit 199. Also, at the branch point A on a downstream side of the introduction detecting unit 258 in the transporting direction, a guide flap 259 is provided. The guide flap 259 is driven by a solenoid or the like, and switches guides of the paper M being transported through the introduction path 243 between the first branch path 244 and the second branch path 245.

Further, on the downstream end of the first branch path 244, a first regulating flap 261, which allows the paper M to move from the first branch path 244 to the first reversing path 248 but regulates movement of the paper M from the first reversing path 248 to the first branch path 244, is provided. Further, on the downstream end of the second branch path 245, a second regulating flap 262 which allows the paper M to move from the second branch path 245 to the second reversing path 249 but regulates the movement of the paper M from the second reversing path 249 to the second branch path 245 is provided. These first regulating flap 261 and second regulating flap 262 are biased due to a bias force generated by a biasing member (not illustrated) so as to block a downstream end of the first branch path 244 or the second branch path 245.

In addition, a first detecting unit 281 which detects the paper M is disposed on the first branch path 244, and a second detecting unit 282 which detects the paper M is disposed on the second branch path 245. In addition, a third detecting unit 283 which detects the paper M is disposed on the first merging path 246. Further, a fourth detecting unit 284 which detects the paper M is disposed on the first deriving path 250*a*, and a fifth detecting unit 285 which detects the paper M is disposed on the second deriving path 250*b*. Also, the first to fifth detecting units 281, 282, 283, 284, and 285 are, for example, a photo interrupter, and a specific configuration thereof is the same as that of the transportation detecting unit 199. Also, the number of the detecting units in each transportation path can be set to a certain number depending on a form or the like of each transporting path.

In the first reversing unit 241, a first reverse detecting unit 264 which detects the paper M sent to the first reversing path 248 and a first pair of reversing rollers 265 (two pairs in the embodiment) provided on the first reversing path 248 are disposed. The first pair of reversing rollers 265 is forwardly rotary-driven or reversely rotary-driven based on a signal transmitted when the first reverse detecting unit 264 detects the paper M by a first reversing motor (not illustrated).

In addition, in the second reversing unit 242, a second reverse detecting unit 267, which detects the paper M drawn to the second reversing path 249, and a second pair of reversing rollers 268 (five pairs in the embodiment) provided on the second reversing path 249 are disposed. The second pair of reversing rollers 268 is forwardly rotary-driven or reversely rotary-driven by a second reversing motor (not illustrated) based on a signal transmitted when the second reverse detecting unit 267 detects the paper M. Also, the first and second reverse detecting units 264 and 267 are, for example, a photo interrupter, and a specific configuration is the same as that of the transportation detecting unit 199.

Next, a configuration of the post-processing device 300 will be described. As illustrated in FIG. 1, the post-processing device 300 includes a substantially box-shaped frame body 320. The frame body 320 includes a post-process paper feeding port 322 and a post-process paper discharging port 323. The post-process paper feeding port 322 and the post-process paper discharging port 323 are respectively provided with an opening formed therein, the post-process paper feeding port 322 disposed to correspond to the downstream end of the intermediate transporting path 218 in the intermediate transporting device 200, and the intermediate transporting path 218 and the downstream side transporting path 319 are connected thereto. Also, the downstream side transporting path 319 is disposed from the post-process paper feeding port 322 over the post-process paper discharging port 323, the transported paper M from the intermediate transporting device 200 is supplied from the post-process paper feeding port 322, a post-process or the like is executed on the paper M, and then the paper is discharged from the post-process paper discharging port 323.

Inside the frame body 320, a stacker 328, a post-processing unit 325, and the like are disposed. The stacker 328 is a stacker on which the paper M is temporarily placed, and includes a placing surface 328*a* having a substantially flat surface, which is capable of placing the paper M, and a wall surface 328*b*, which is formed in an approximately right angle direction with respect to an end portion of the placing surface 328*a*.

The post-processing unit 325 performs a post-process on the paper M in a state of being placed on the stacker 328 using an appropriate mechanism, and the post-process is a punching process of perforating a punch hole in the paper M, a stapling process of binding the paper M in each of a predetermined number of sheets, a shifting process of shifting and adjusting a position of the paper M in the width direction in each sheet or each bundle in the width direction, or the like. Also, a mechanism capable of performing a paper folding unit, which performs a folding process of the paper M, a cutting process of cutting the paper M, a signature process of folding the paper M, a bookbinding process of bookbinding the paper M or a collating process, and the like, may be provided in the post-processing unit 325.

In addition, inside the frame body 320, a downstream side transporting unit 335 is disposed along the downstream side transporting path 319. The downstream side transporting unit 335 includes a pair of transporting rollers 327 being driven by a driving motor (not illustrated). Also, a pair of paper discharging rollers 329 is disposed near the post-process paper discharging port 323 in the downstream side transporting path 319. The pair of transporting rollers 327 is disposed on an upstream side of the stacker 328 and the post-processing unit 325 in the downstream side transporting path 319, and transports the paper M supplied from the post-process paper feeding port 322 to the stacker 328. In addition, a transportation detecting unit 356 detecting the paper M is disposed near the post-process paper feeding port 322 in the downstream side transporting path 319. The transportation detecting unit 356 is, for example, a photo interrupter, and a specific configuration thereof is the same as that of the transportation detecting unit 199.

In addition, inside the frame body 320, a guiding unit 330, which guides the paper M being transported along the downstream side transporting path 319, is provided. The guiding unit 330 has a protruding shape. Also, the guiding unit 330 includes a guiding surface 330*a* having a substantial flat surface, and the guiding surface 330*a* is disposed to face the downstream side transporting path 319 (stacker 328). A dimension width of the guiding surface 330*a* of the embodiment substantially orthogonal to the transporting direction of the paper M is substantially the same as a dimension width of the paper M orthogonal to the transporting direction. Accordingly, it is possible to easily transport the paper M. The guiding unit 330 is disposed on the downstream side of the pair of transporting rollers 327 in the downstream side transporting path 319 and on the upstream side of the pair of paper discharging rollers 329. Accordingly, the transported paper M from the pair of transporting rollers 327 is transported to the stacker 328 through the guiding unit 330.

The stacker 328 of the embodiment is disposed on the downstream side of the pair of transporting rollers 327 in the downstream side transporting path 319, and temporarily places the paper M to be processed by the post-processing unit 325. Also, the placing surface 328*a* of the stacker 328 is obliquely disposed so that at least one sides of a plurality of the paper M placed on the stacker 328 are aligned. In the embodiment, one end of the stacker 328 is disposed on a post-process paper discharging port 323 side, and the other end (wall surface 328*b*) of the stacker 328 is disposed on a post-processing unit 325 side. The post-process paper discharging port 323 is disposed on an upper side of the post-processing unit 325, and the stacker 328 is obliquely disposed on a lower side toward the post-processing unit 325. Accordingly, one end sides of the paper M placed on the stacker 328 come into contact with the wall surface 328*b* of the stacker 328, and thus the one end sides of the paper M are aligned.

Figure 4:
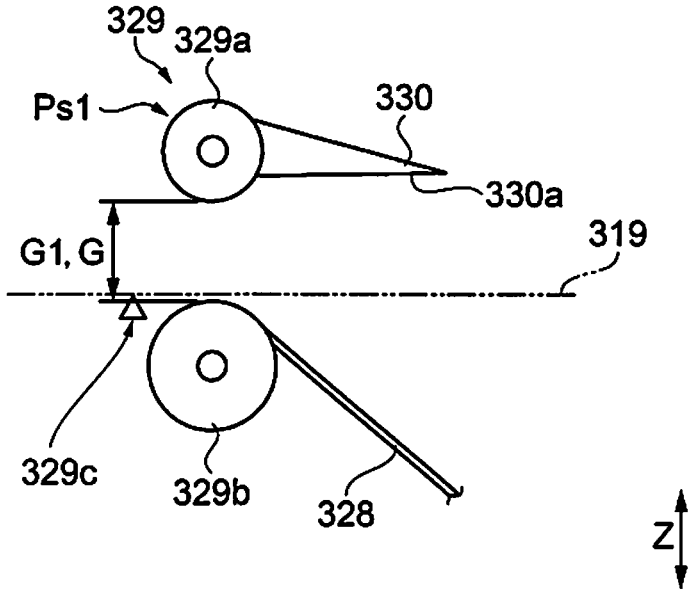
FIG. 4 is a description view for describing an operation of a post-processing device.
Figure 5:
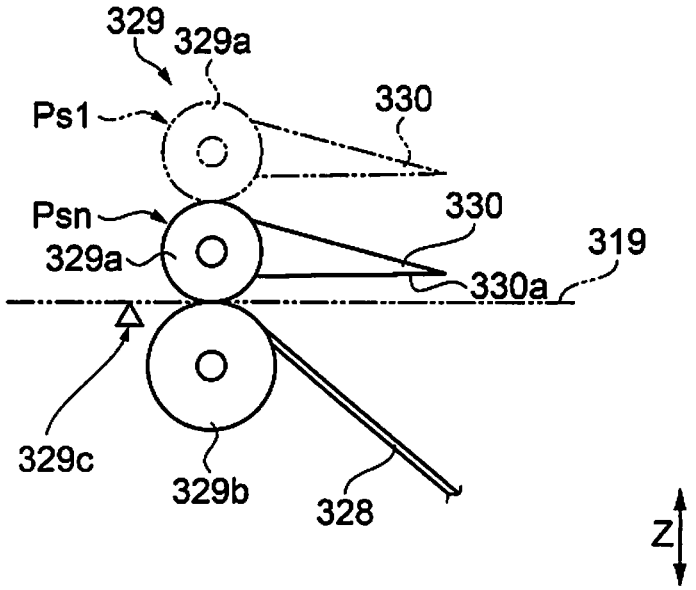
FIG. 5 is a description view for describing the operation of the post-processing device.

FIGS. 4 and 5 are description views for describing an operation of the pair of paper discharging rollers 329 of the post-processing device 300. The pair of paper discharging rollers 329 is disposed on the one end side of the stacker 328, and is configured to discharge the paper M placed on the stacker 328 one sheet by one sheet or as a bundle having a predetermined number of sheets. The pair of paper discharging rollers 329 includes a first paper discharging roller 329*a* and a second paper discharging roller 329*b*. The first paper discharging roller 329*a* and the second paper discharging roller 329*b* are arranged in the vertical direction Z, and the first paper discharging roller 329*a* is disposed on an upper side of the second paper discharging roller 329*b*. Also, the first paper discharging roller 329*a* and the second paper discharging roller 329*b* are configured to be capable of separating from and pressure-welding with each other. In the embodiment, the first paper discharging roller 329*a* is configured to be movable with respect to the second paper discharging roller 329*b* by a driving motor.

Also, when the transported paper M from the pair of transporting rollers 327 are placed on the stacker 328, as illustrated in FIG. 4, the pair of paper discharging rollers 329 is separated from one another. At this time, the first paper discharging roller 329*a* is disposed at a first position Ps1, where a gap G between the first paper discharging roller 329*a* and the second paper discharging roller 329*b* becomes a first gap G1. The first position Ps1 is a regulated home position, and the first gap G1 has a value of which the gap G between the first paper discharging roller 329*a* and the second paper discharging roller 329*b* is the maximum. Also, the gap G is a gap in a direction where the paper M is pinched between the first paper discharging roller 329*a* and the second paper discharging roller 329*b*, and has a shortest length between the outermost circumferential surface of the first paper discharging roller 329*a* and the outermost circumferential surface of the second paper discharging roller 329*b*. Also, a part of the paper M passes through between the first paper discharging roller 329*a* and the second paper discharging roller 329*b* in this state, and then, as illustrated in FIG. 5, the first paper discharging roller 329*a* and the second paper discharging roller 329*b* are pressure-welded (nipped) so as to pinch the paper M therebetween, and the pairs of paper discharging rollers 329 (first paper discharging roller 329*a* and second paper discharging roller 329*b*) are rotated in a pull-back direction to a stacker 328 side. Accordingly, the paper M is placed on the stacker 328. At this time, the first paper discharging roller 329*a* is positioned on a lower side of the first position Ps1, and moves to a nip position Psn where the paper M is nipped by the first paper discharging roller 329*a* and the second paper discharging roller 329*b*. Also, until the paper M having a predetermined number of sheets is placed on the stacker 328, separating and pressure-welding operations by the first paper discharging roller 329*a* and the second paper discharging roller 329*b* are repeated.

In addition, in a case in which the paper M on which the post-process is executed by the post-processing unit 325 is discharged to a paper discharging tray 331 side, the paper M having a predetermined number of sheets is nipped, and the pairs of paper discharging rollers 329 (first paper discharging roller 329*a* and second paper discharging roller 329*b*) are rotated in an opposite direction of that of the stacker 328 side where the paper is transported. Accordingly, the paper M can be discharged to the paper discharging tray 331 side. At this time, the first paper discharging roller 329*a* is disposed at a nip position Psn where the paper M placed on the stacker 328 is nipped by the first paper discharging roller 329*a* and the second paper discharging roller 329*b* (refer to FIG. 5). The pair of paper discharging rollers 329 (first paper discharging roller 329*a* and second paper discharging roller 329*b*) is a roller corresponding to a discharging roller in the disclosure. In addition, a paper detector 329*c* (refer to FIGS. 4 and 5) which detects the paper M is disposed near the post-process paper discharging port 323 on the downstream side of the pair of paper discharging rollers 329. The paper detector 329*c* is, for example, a photo interrupter, and a specific configuration thereof is the same as that of the transportation detecting unit 199. The paper detector 329*c* corresponds to a medium detector in the disclosure. A signal of a detected result by the paper detector 329*c* is sent to the controller 10 (refer to FIG. 13), and is used for an advance and retreat control of the sheet member 340.

The paper discharging tray 331 is provided in the outside of the frame body 320, and places the paper M discharged from the post-process paper discharging port 323 thereon. The paper discharging tray 331 includes a placing surface 331*a* on which the paper M is loaded (placed) and is provided to protrude to the outside of the frame body 320. The paper discharging tray 331 can move (that is, lifted) in an upward vertical direction and a downward vertical direction by a lifting mechanism 332 (refer to FIG. 13) constituted by a motor, gear, or the like. A paper surface detector 331*b* (refer to FIG. 1) which detects an upper surface position of the paper M placed on the placing surface 331*a* is provided near the placing surface 331*a* of the paper discharging tray 331. The paper surface detector 331*b* corresponds to a medium surface detector in the disclosure. A signal of a detected result by the paper surface detector 331*b* is sent to the controller 10 (refer to FIG. 13) and is used for a lifting control of the paper discharging tray 331. Specifically, the controller 10 controls the lifting mechanism 332 and lifts the paper discharging tray 331 based on an upper surface position detected by the paper surface detector 331*b* so that the downstream end of the sheet member 340 at an "advance position" (to be described later) is positioned above an upper surface of the paper M placed on the placing surface 331*a*.

Here, with reference to FIGS. 6 to 12C, the sheet member 340 (supporting member) for suppressing downward-bending of the paper M discharged from the post-process paper discharging port 323 (the downstream end of the paper M in a discharging direction abuts an upper surface of the paper M precedently placed on the paper discharging tray 331 so as to be curved downward) will be described.

Figure 6:
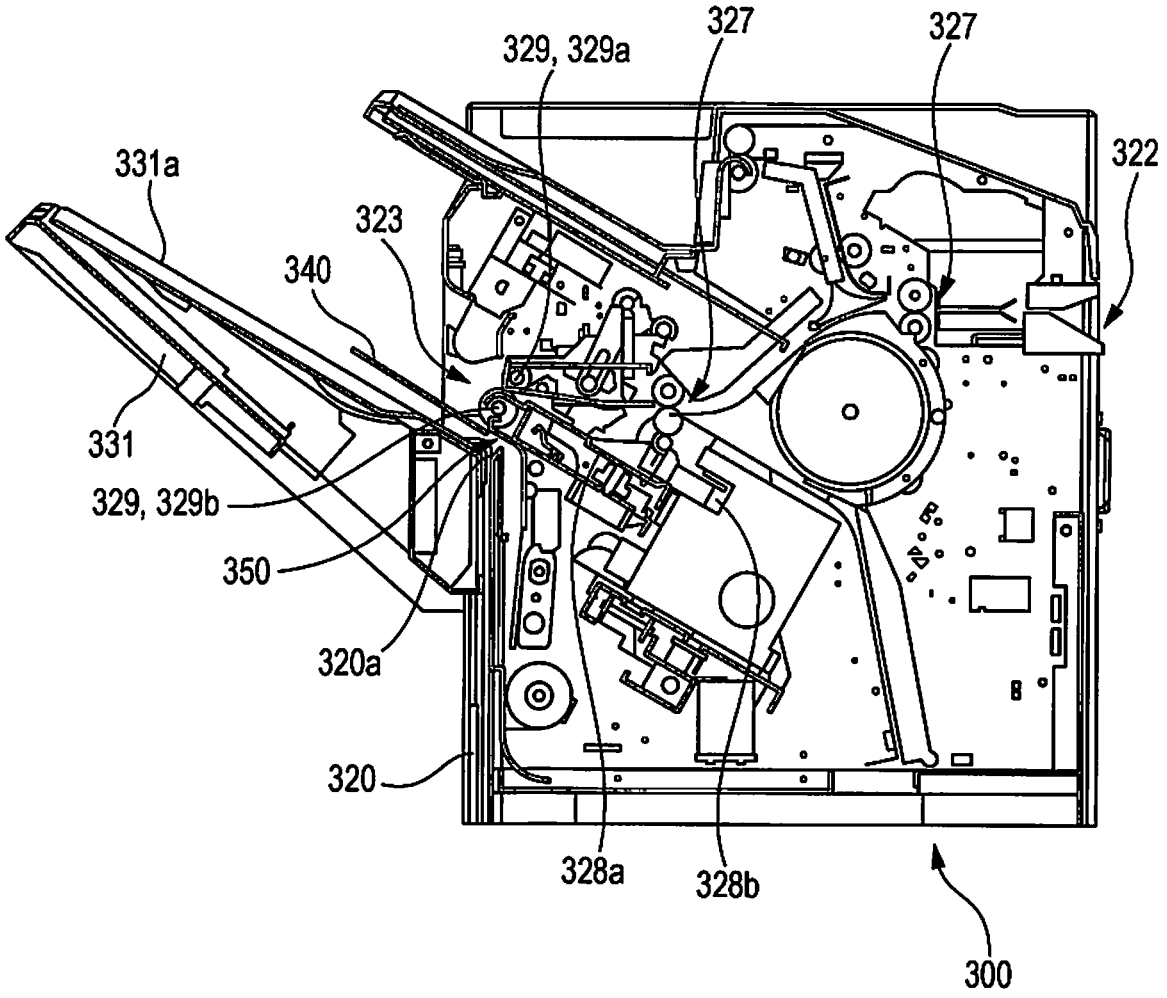
FIG. 6 is a configuration view illustrating a configuration of periphery of a sheet member of the post-processing device.
Figure 7:
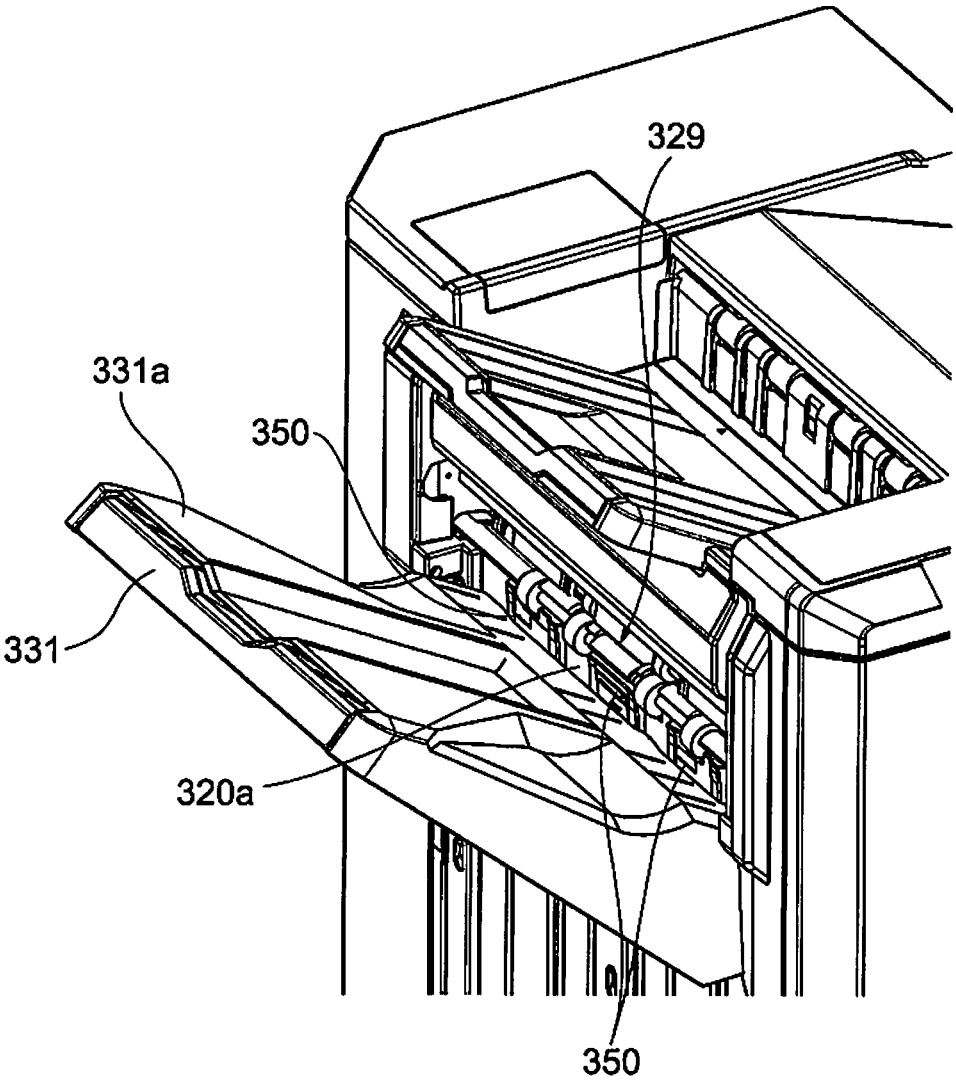
FIG. 7 is a perspective view when the sheet member of the post-processing device is present at a retreat position.
Figure 8:
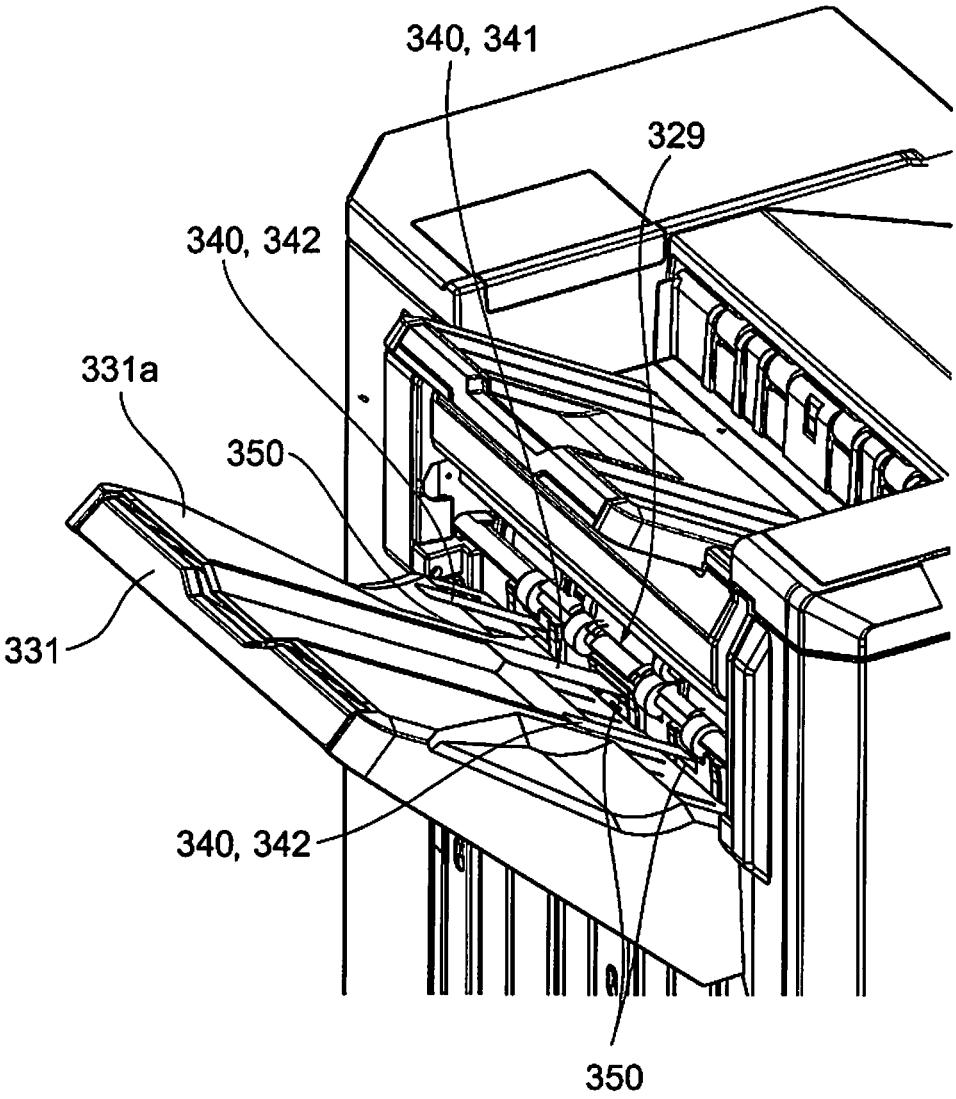
FIG. 8 is a perspective view when the sheet member of the post-processing device is present at an advance position.

As illustrated in FIG. 6, the sheet member 340 which is advanceable and retreatable between a "retreat position" on an upstream side and a "advance position" on a downstream side in a paper discharging direction is provided in a space between the pair of paper discharging rollers 329 and the placing surface 331*a* of the paper discharging tray 331. The sheet member 340 is configured to protrude from a sheet entrance 350, which is provided between a pressure-welding (nipping) position of the pair of paper discharging rollers 329 disposed near the post-process paper discharging port 323 and the placing surface 331*a* of the paper discharging tray 331, to the outside of the frame body 320 in the vertical direction Z. The sheet member 340 is a member having flexibility, which is made of a material (for example, resin material such as polyethylene terephthalate) having a friction resistance, with a low friction coefficient of a surface. In the embodiment, a friction coefficient of an upper surface of the sheet member 340 is set to be equal to or lower than a friction coefficient of the placing surface 331*a* of the paper discharging tray 331.

A position of the downstream end of the sheet member 340 in the paper discharging direction at the "retreat position" (refer to FIG. 7) is disposed on an upstream side in the paper discharging direction of a position of an upstream end in the paper discharging direction of the paper M which is discharged and dropped to the paper discharging tray 331. In the embodiment, the upstream end of the paper M, which is discharged and dropped to the paper discharging tray 331 the post-process paper discharging port 323, abuts a vertical wall 320*a* (refer to FIGS. 6 and 7) which is a part of the frame body 320. Therefore, the position of the downstream end of the sheet member 340 at the "retreat position" is disposed on a slightly upstream side (that is, inside the frame body 320) of the vertical wall 320*a*.

A position on a downstream end of the sheet member 340 in the paper discharging direction at the "advance position" (refer to FIGS. 6 and 8) is disposed on the downstream side in the paper discharging direction of a position where a downstream end of the paper M in the paper discharging direction, which is discharged in a case in which the sheet member 340 is not present, primally comes into contact with an upper surface of the paper M (preceding medium) precedently placed on the placing surface 331*a*. In addition, an angle between the downstream end of the paper M being discharged and the upper surface of the sheet member 340 at the "advance position" is set to be smaller than an angle between the downstream end of the paper M being discharged in a case in which the sheet member 340 is not present and an upper surface of the paper M (preceding medium) precedently placed on the placing surface 331*a*.

Figure 9:
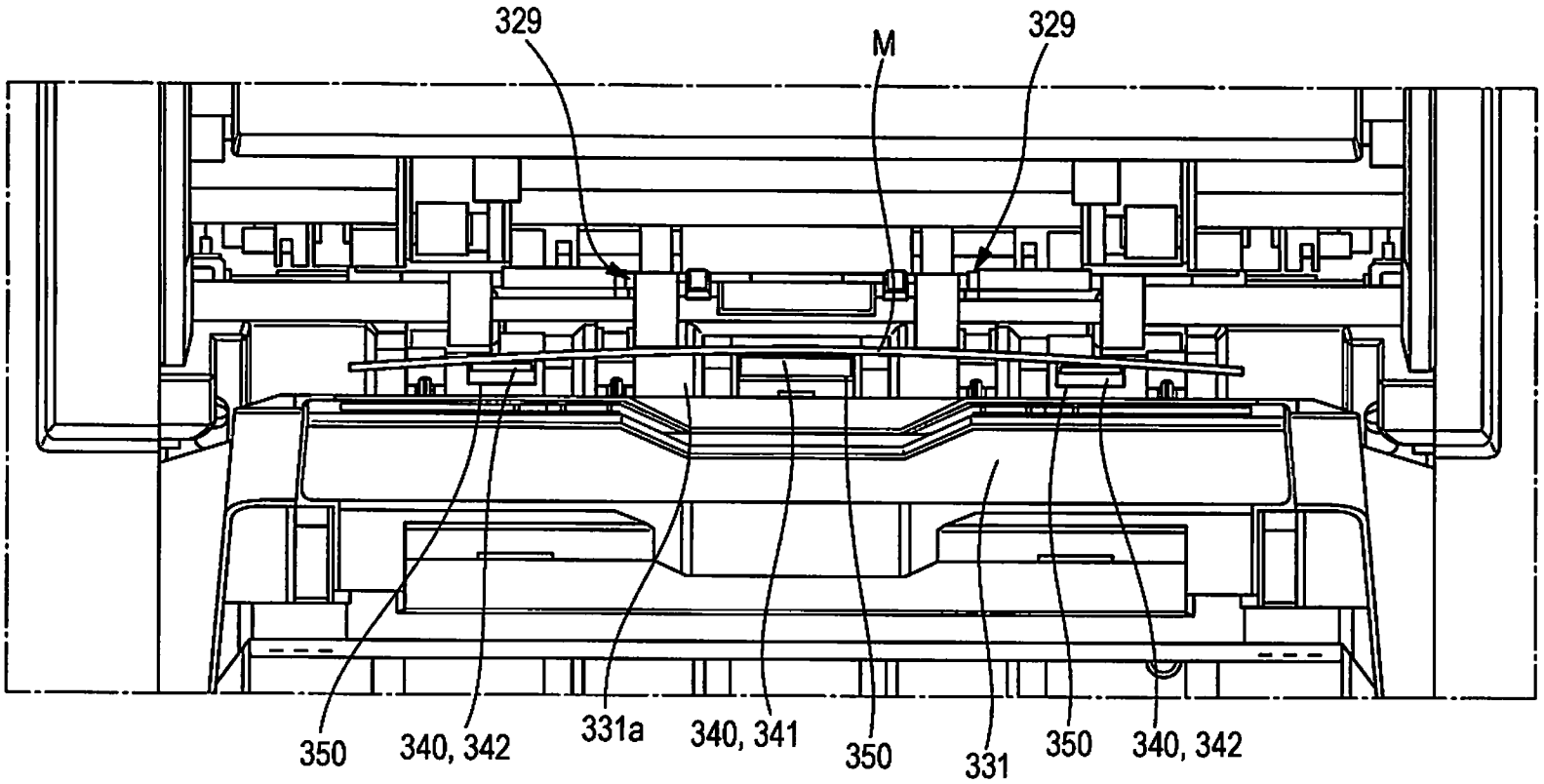
FIG. 9 is a view illustrating the periphery of the sheet member of the post-processing device when seen from a downstream side in a transporting direction.

As illustrated in FIG. 9, a plurality of the sheet members 340 are disposed in the width direction of the paper M. An advance and retreat position of a sheet member (center sheet member) 341 being disposed near the center of the paper M in the width direction is disposed an upper side in the vertical direction of an advance and retreat position of a sheet member (end portion sheet member) 342 being disposed near an end portion of the paper M in the width direction. In addition, as illustrated in FIG. 9, a width of the center sheet member 341 is set to be wider than a width of the end portion sheet member 342, and a thickness of the center sheet member 341 is set to be thicker than a thickness of the end portion sheet member 342.

Figure 10:
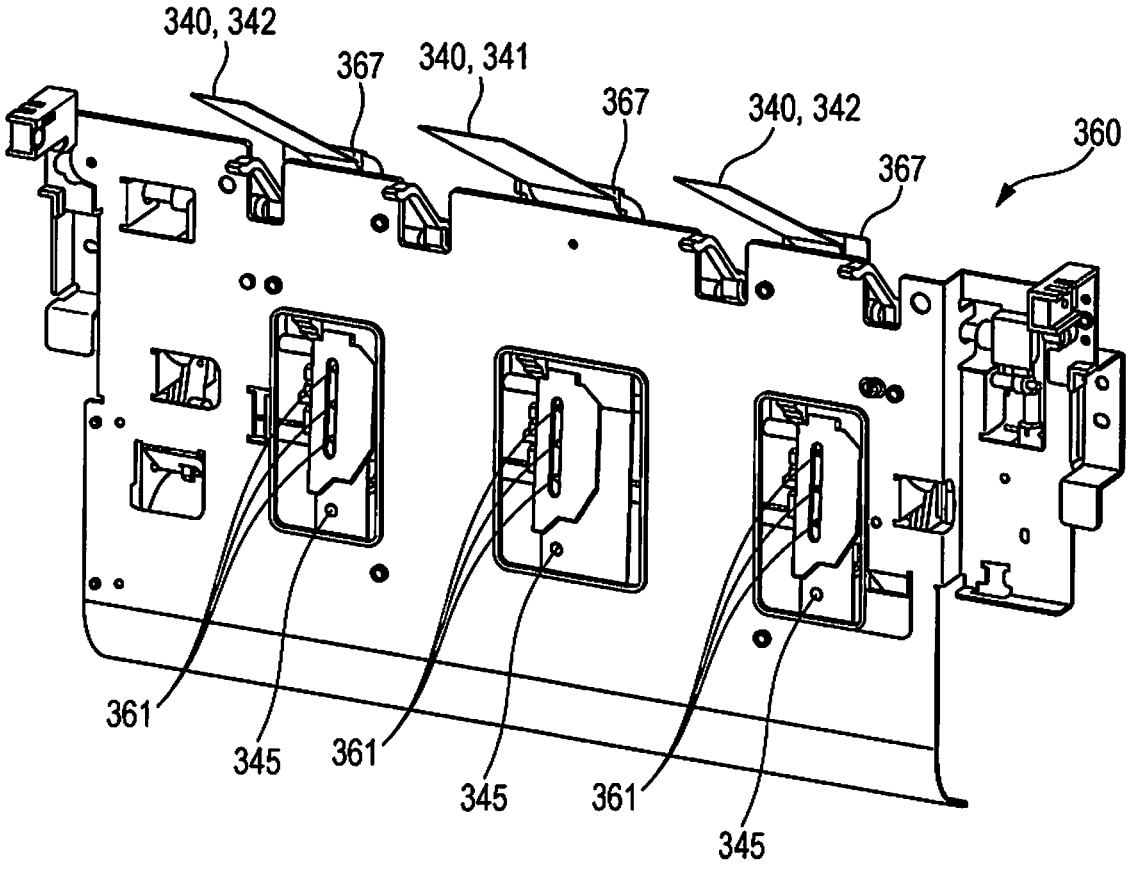
FIG. 10 is a perspective view illustrating a tractor unit which drives the sheet member of the post-processing device when seen from the downstream side in the transporting direction.
Figure 11:
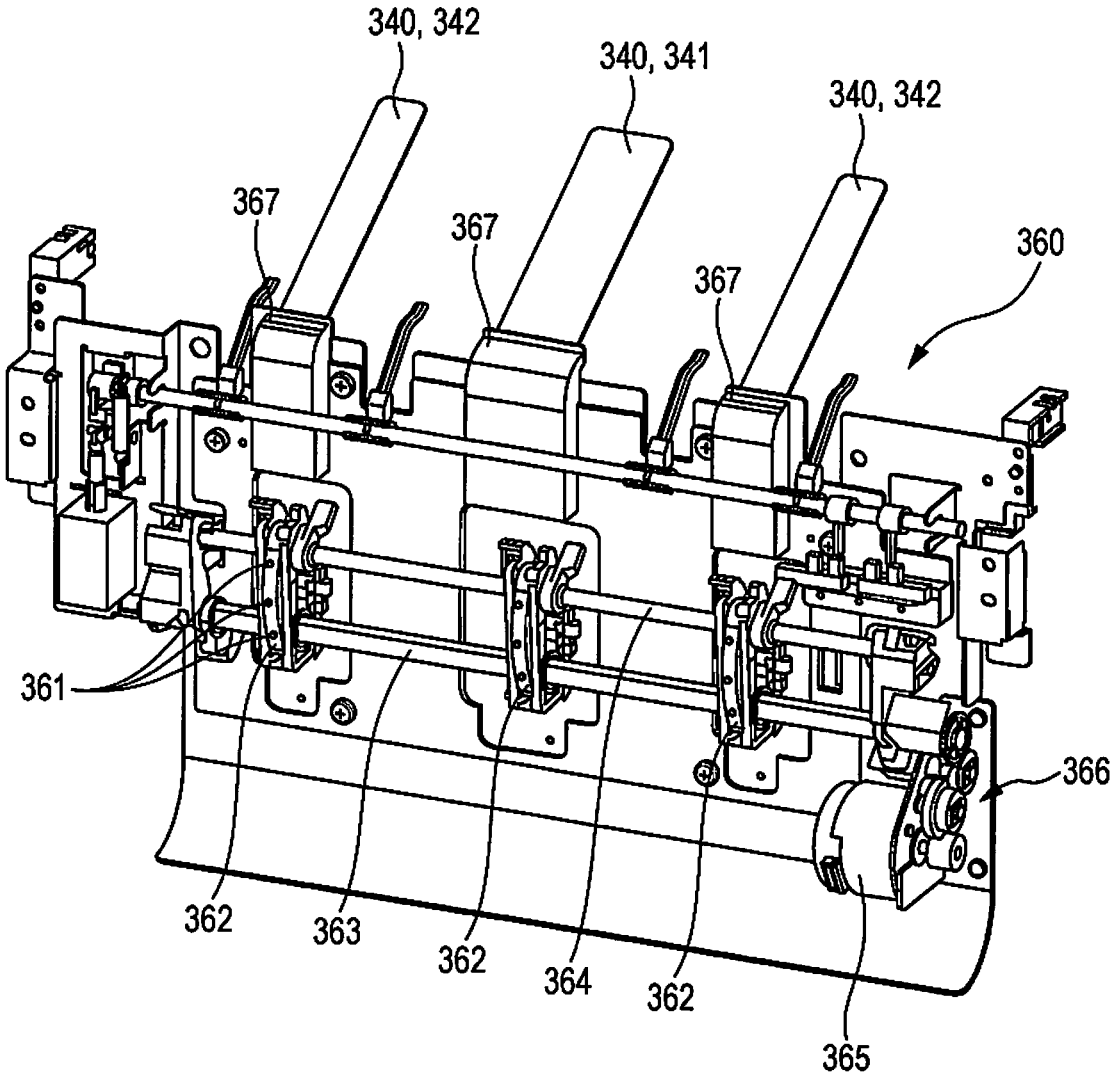
FIG. 11 is a perspective view illustrating a tractor unit which drives the sheet member of the post-processing device when seen from an upstream side in the transporting direction.

The sheet member 340 in the embodiment is driven by the tractor unit 360. The tractor unit 360 has a configuration similar to that of a tractor unit in a printer of related art which is used when fanfold paper is transported. As illustrated in FIGS. 10 and 11, the tractor unit 360 includes a tractor pin 361 which is inserted into a sprocket hole 345 provided in the sheet member 340, a tractor belt 362 in which the tractor pin 361 is provided, a driving shaft 363 and a driven shaft 364 extending through the tractor belt 362, a tractor motor 365 generating a rotation driving force, a group of gears 366 transmitting the rotation driving force of the tractor motor 365 to the driving shaft 363, and the like. Driving of the tractor motor 365 is controlled by the controller 10 (refer to FIG. 13), the rotation driving force of the tractor motor 365 is transmitted to the tractor belt 362 through the group of gears 366 and the driving shaft 363, and the sheet member 340 attached to the tractor pin 361 of the tractor belt 362 advances and retreats.

In the embodiment, as illustrated in FIGS. 10 and 11, a plurality of the sprocket holes 345 is provided on a part of an upstream side (for example, half from the center) of the sheet member 340 in an advancing direction, and the tractor pins 361 of the tractor unit 360 is inserted into these sprocket holes 345. Accordingly, the sheet member 340 can move in the vertical direction in a state in which a part thereof on an upstream side in the advancing direction is supported by the tractor pin 361. Meanwhile, the sprocket hole 345 is not provided on a part on the downstream side (for example, upper half from the center) of the sheet member 340 in the advancing direction. At least, the sprocket hole 345 is not provided below a position where the downstream end in the paper discharging direction of the paper M being discharged in a case in which the sheet member 340 is not present primally comes into contact with an upper surface of the paper M (preceding medium) precedently placed on the placing surface 331*a*. Accordingly, it is possible to suppress that the downstream end of the paper M being discharged is hooked to the sprocket hole 345. In addition, the downstream side of the sheet member 340 in the advancing direction is regulated by a direction changing unit 367 provided on an upper side (the downstream side of the sheet member 340 in the advancing direction) of the tractor unit 360, and extends at a predetermined angle in a direction with respect to the vertical direction Z.

Figure 12A:
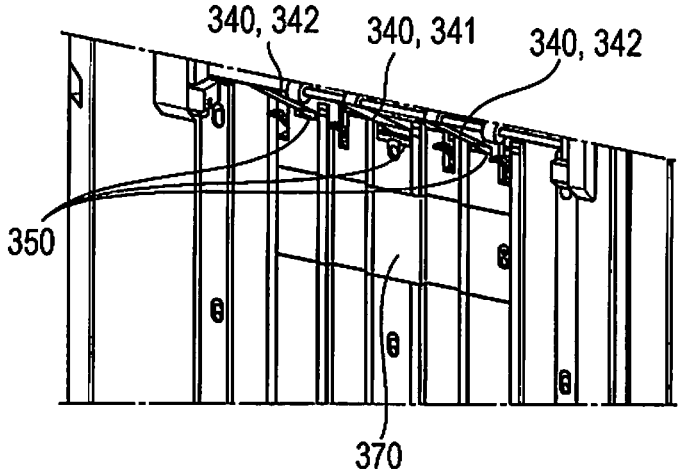
FIGS. 12A to 12C are description views for describing an exchanging method of the sheet member of the post-processing device
Figure 12B:
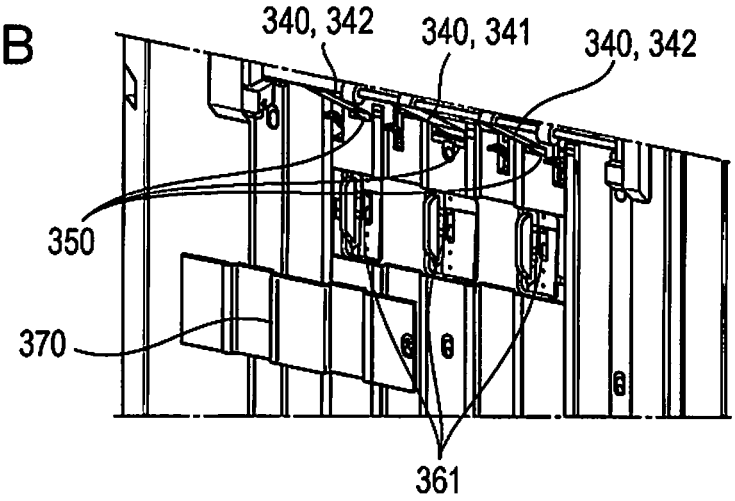
Figure 12C:
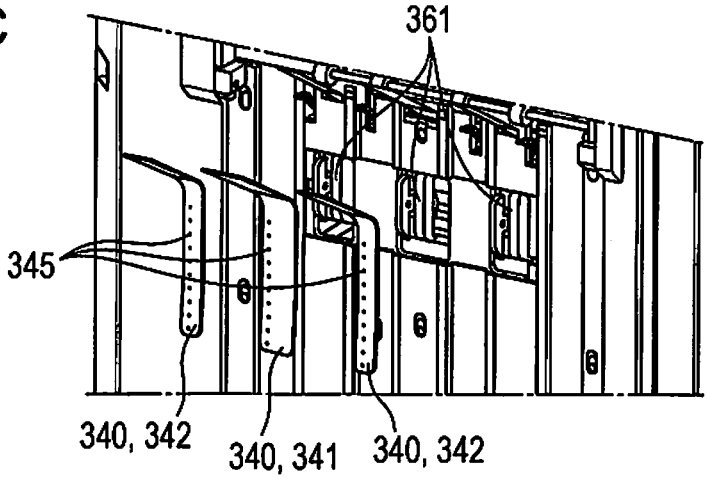

Also, in the embodiment, as illustrated in FIG. 12A, a cover member 370 which can be taken out from a front surface of the frame body 320 of the post-processing device 300 is provided. In order to take out the cover member 370, the paper discharging tray 331 is needed to be lowered at a lower position than an install range of the cover member 370. Through an order in which the cover member 370 is taken out as illustrated in FIG. 12B, the sheet member 340 is taken out from the tractor pin 361 as illustrated in FIG. 12C, and the tractor pin 361 is inserted into the sprocket hole 345 of a new sheet member 340, the sheet member 340 is easily exchanged. After the cover member 370 is attached, a height position of the paper discharging tray 331 is adjusted based on a detected result by the paper surface detector 331*b*.

The sheet member 340 is controlled by the controller 10 so as to advance to the "advance position" when the downstream end of the paper M, which is discharged by the pair of paper discharging rollers 329, is discharged. Specifically, the sheet member 340 is controlled by the controller 10 through the tractor unit 360 so as to advance to the "advance position" after the downstream end of the discharged paper M is detected by the paper detector 329*c* and before the downstream end of the discharged paper M comes into contact with an upper surface of the upper surface of the sheet member 340.

Meanwhile, the sheet member 340 is controlled by the controller 10 so as to retreat to the "retreat position" when an upstream end of the paper M, which is discharged by the pair of paper discharging rollers 329, is discharged. Specifically, the sheet member 340 is controlled by the controller 10 through the tractor unit 360 so as to retreat to the "retreat position" after the upstream end of the discharged paper M is detected by the paper detector 329*c* and before the discharged paper M is dropped to the placing surface 331*a* of the paper discharging tray 331.

Figure 13:
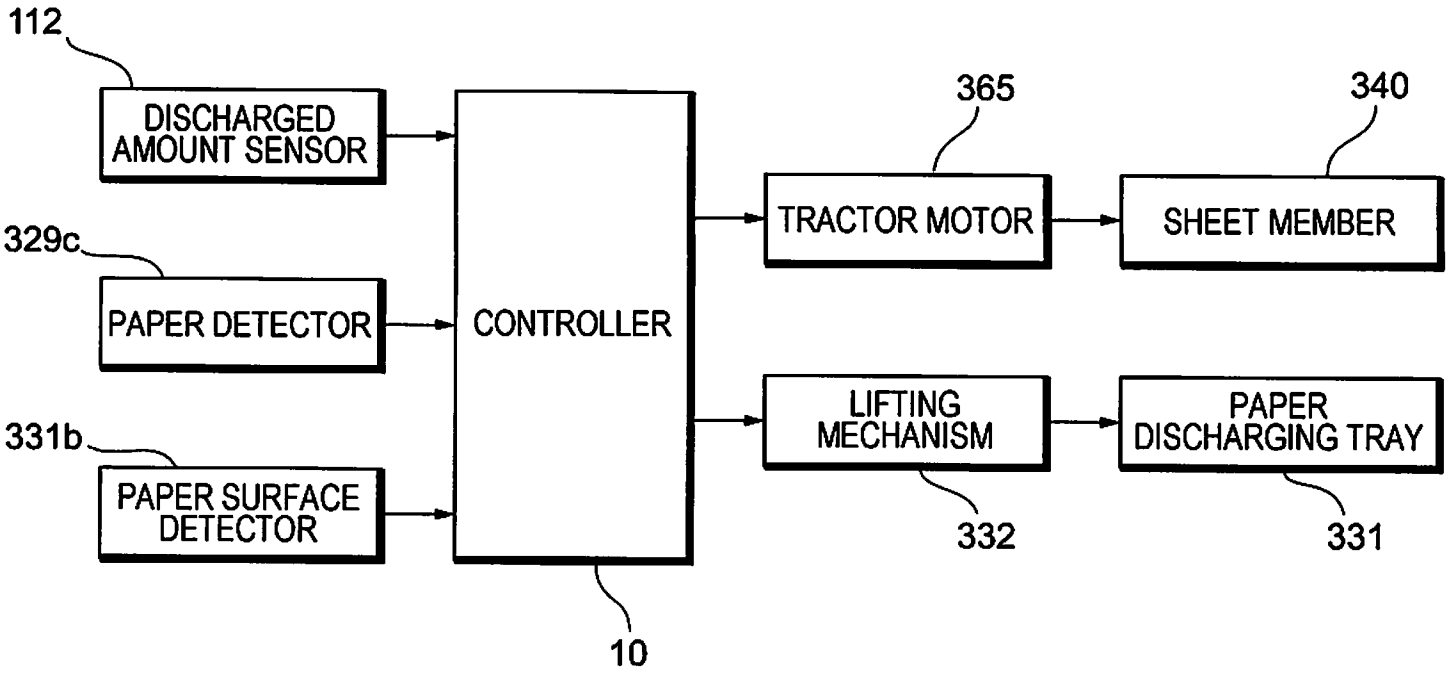
FIG. 13 is a block diagram illustrating a partial configuration of a controller of the printing apparatus.

Next, with reference to a block diagram of FIG. 13, a configuration of the controller 10 of the printing apparatus 1 will be described. Also, in FIG. 13, only configurations relating to controls of the sheet member 340 and the paper discharging tray 331 of the post-processing device 300 are illustrated, and description of configurations relating to controls of various members (roller or the like) of the image forming device 100 and the intermediate transporting device 200 will be omitted.

The controller 10 includes a CPU, a ROM, a RAM and an inputting and outputting interface as a recording device, processes various signals input by the CPU through the inputting and outputting interface based on data of the ROM and RAM, and outputs a control signal to each driving unit through the inputting and outputting interface. The CPU performs, for example, various controls based on a control program stored in the ROM.

In the controller 10, each detecting unit (discharged amount sensor 112, paper detector 329*c*, paper surface detector 331*b*, and the like) is connected, and a detected data from the detecting unit is transmitted. In addition, in the controller 10, each driving source (tractor motor 365, lifting mechanism 332, and the like) is connected, and a drive controlling signal, which is generated based on detected data, is transmitted from the controller 10 to each driving source, such that driving of each driving source is controlled. Also, in accordance with driving of each driving source, a member (sheet member 340, paper discharging tray 331, and the like) connected to each driving source is driven.

Figure 14:
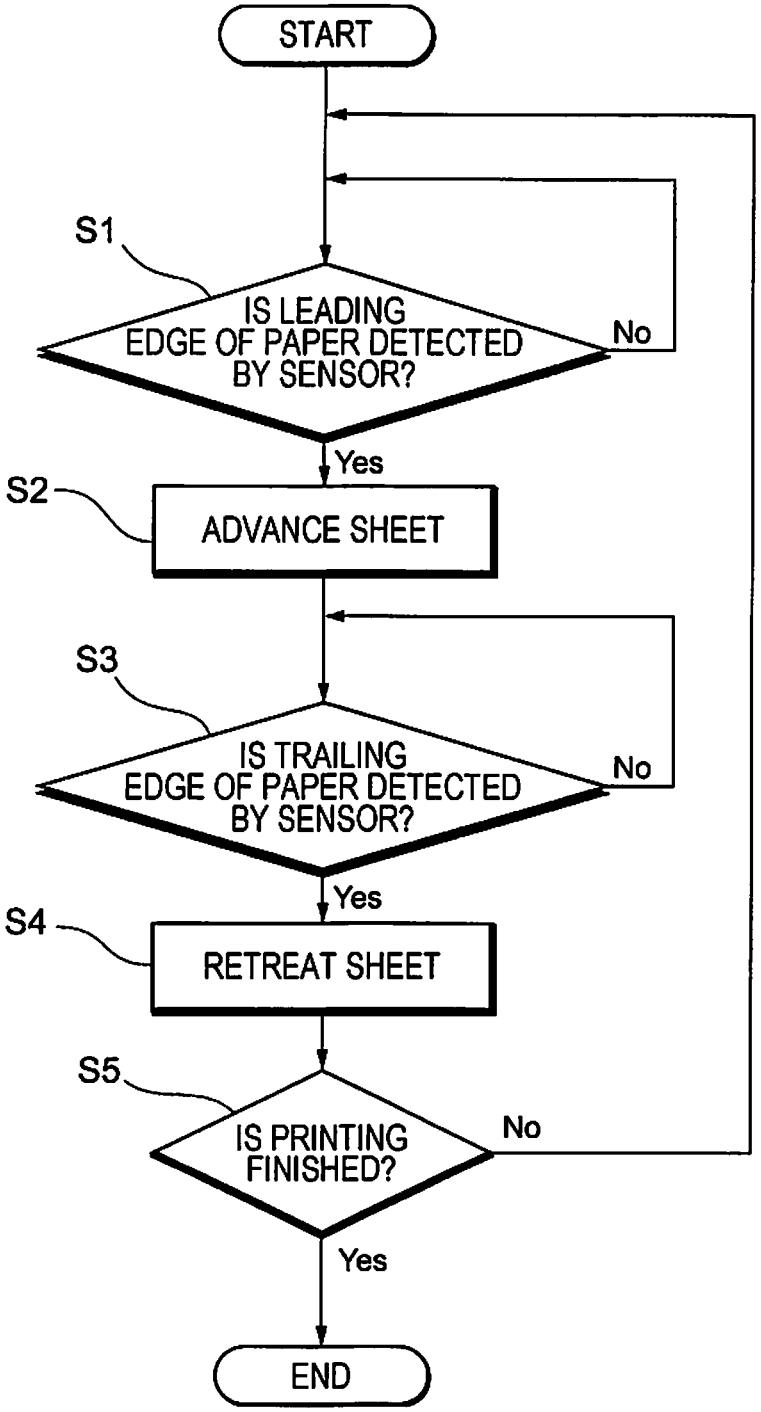
FIG. 14 is a flow chart for describing an advance and retreat control of the sheet member of the post-processing device.

Subsequently, with reference to a flow chart of FIG. 14, an advance and retreat control method of the sheet member 340 of the post-processing device 300 will be described.

First, the controller 10 determines whether or not the downstream end (leading edge) of the paper M discharged by the pair of paper discharging rollers 329 is detected by the paper detector 329*c* (leading edge determining process: S1), and in a case in which the downstream end of the paper is detected, when the sheet member 340 is controlled by through the tractor unit 360, the sheet member 340 advances to the "advance position" (sheet advancing process: S2). At this time, the controller 10 controls the sheet member 340 to advance to the "advance position" before the downstream end (leading edge) of the paper M being discharged comes into contact with the upper surface of the sheet member 340.

Next, the controller 10 determines whether or not the upstream end (trailing edge) of the paper M discharged by the pair of paper discharging rollers 329 is detected by the paper detector 329*c* (trailing edge determining process: S3), and in a case in which the upstream end of the paper is detected, when the sheet member 340 is controlled by through the tractor unit 360, the sheet member 340 retreats to the "retreat position" (sheet retreating process: S4). At this time, the controller 10 controls the sheet member 340 to retreat to the "retreat position", before the discharged paper M is dropped to the placing surface 331*a* of the paper discharging tray 331.

The controller 10 repeats the leading edge determining process S1, the sheet advancing process S2, the trailing edge determining process S3, and the sheet retreating process S4 until printing is finished (finish determining process: S5), and finishes the advance and retreat control of the sheet member 340 in a case in which the printing is finished.

In the post-processing device 300 according to the embodiment described above, since the sheet member 340 is configured to be advanceable and retreatable between the "retreat position" on the upstream side and the "advance position" on the downstream side in the paper discharging direction in a space between the pair of paper discharging rollers 329 and the placing surface 331*a* of the paper discharging tray 331, the friction coefficient of the upper surface of the sheet member 340 is set to be equal to or lower than the friction coefficient of the placing surface 331*a*, and the position of the downstream end of the sheet member 340 at the "advance position" is disposed on the downstream side of a position where the downstream end of the paper M (succeeding medium) discharged in a case in which the sheet member 340 is not present primally comes into contact with an upper surface of the preceding medium (the paper M precedently placed on the placing surface 331*a* of the paper discharging tray 331), the downstream end of the succeeding medium is capable of preferentially coming into contact with the upper surface of the sheet member 340 having a relatively low friction coefficient before the upper surface of the preceding medium. Accordingly, it is possible to prevent that the downstream end of the succeeding medium abuts the upper surface of the preceding medium so as to be curved downward.

In addition, in the post-processing device 300 according to the embodiment described above, since an angle between the downstream end of the paper M being discharged (succeeding medium) and the upper surface of the sheet member 340 at the "advance position" is smaller than an angle between the downstream end of the paper M being discharged (the succeeding medium) in a case in which the sheet member 340 is not present and the upper surface of the preceding medium, the downstream end of the succeeding medium is capable of coming into contact with the upper surface of the sheet member 340 at an acute angle as compared to a case in which the downstream end thereof comes into contact with the upper surface of the preceding medium. Accordingly, it is possible to more effectively prevent the downstream end of the succeeding medium from being curved downward.

In addition, in the post-processing device 300 according to the embodiment described above, since the position of the downstream end of the sheet member 340 at the "retreat position" is disposed on the upstream side of a position on an upstream end of the paper M, which is discharged to the paper discharging tray 331 and dropped, dropping of the paper M to the paper discharging tray 331 does not interfere with the sheet member 340.

In addition, in the post-processing device 300 according to the embodiment described above, since the advance and retreat position of the sheet member (center sheet member) 341 disposed near the center of the paper M in the width direction is disposed on an upper side in the vertical direction than the advance and retreat position of the sheet member (end portion sheet member) 342 disposed near an end portion of the paper M in the width direction, even in a case in which a part near the end portion of the paper M in the width direction on which printing is executed is bent so as to be risen, such bending thereof can be suppressed, and contact of the succeeding medium with the part near the end portion of the preceding medium in the width direction can be suppressed.

In addition, in the post-processing device 300 according to the embodiment described above, since a width of the sheet member (center sheet member) 341 disposed near the center of the paper M in the width direction is widen (and a thickness thereof is thickened), a center portion of the paper M in the width direction can be supported with relatively high strength, and thereby it is possible to more effectively prevent the downstream end of the paper M from being curved downward.

In addition, in the post-processing device 300 according to the embodiment described above, it is possible to lift the paper discharging tray 331 based on a position of the upper surface of the paper M detected by the paper surface detector 331*b*. Accordingly, even in a case in which a plurality of the paper M is piled on the placing surface 331*a* of the paper discharging tray 331, when the paper discharging tray 331 is lowered based on a position of the upper surface of the paper M, the downstream end of the sheet member 340 at the "advance position" can be positioned always above the upper surface of the paper M placed on the placing surface 331*a*.

Also, in the embodiment described above, an example of which the advance and retreat control of the sheet member 340 is performed based on the detected result by the paper detector 329*c* is described, but a method of the advance and retreat control of the sheet member 340 is not limited thereto. For example, after the downstream end of the paper M being discharged starts to move to the downstream side in the paper discharging direction on the sheet member 340, the sheet member 340 can be controlled by the controller 10 so as to retreat to the "retreat position", before the paper M being discharged is dropped to the placing surface 331*a* of the paper discharging tray 331. Such a control is retreating of the sheet member 340 in a case in which the paper M is transported by a predetermined distance (for a predetermined time) from outputting of a discharging instruction of the paper M, and can be realized without using the paper detector 329*c*.

In addition, in the embodiment described above, the post-processing device 300 which performs a pre-process such as the stapler process is applied to the disclosure, an example of which it is prevent that a downstream end of a subsequent "medium bundle" to be described later comes into contact with an upper surface of a preceding "medium bundle" so as to be bent down is described, but the disclosure is not applied to only the post-processing device 300 forming the "medium bundle".

For example, in the image forming device 100, the pairs of transporting rollers 131, which discharge the paper M one by one, are provided downward on the paper discharging tray 109 (FIG. 2) in the vertical direction, and it is possible to provide the sheet member which is configured to be advanceable and retreatable between the "retreat position" on the upstream side and the "advance position" on the downstream side in the paper discharging direction in a space between the pair of transporting rollers 131 and the placing surface of the paper discharging tray 109. Also, a friction coefficient of the upper surface of the sheet member is set to be equal to or lower than a friction coefficient of the placing surface of the paper discharging tray 109, and a position of the downstream end of the sheet member in the paper discharging direction at the "advance position" can be disposed on the downstream side in the paper discharging direction of a position where the downstream end of the paper M being discharged in a case in which the sheet member is not present in a medium discharging direction primally comes into contact with the upper surface of the paper M precedently placed on the placing surface. In this manner, it is possible to prevent that the downstream end of one sheet of a subsequent medium (paper M) comes into contact with the upper surface of a preceding medium so as to be bent down.

The disclosure is not limited to the embodiment described above, and design modifications appropriately made by those skilled in the art to such embodiment are also included in a range of the disclosure as long as the modifications have features of the disclosure. That is, each component, arrangement, material, condition, shape, size, and the like thereof included in the embodiment described above are not limited to the examples which are exemplified, and can be appropriately modified. In addition, the respective element included in the embodiment described above can be technically combined as far as possible, and thus combinations thereof are also included in the range of the disclosure as long as the combinations include the features of the disclosure.

What is claimed is:

1. A medium discharging device comprising:

a discharging roller that is discharging a medium;

a paper discharging tray that is disposed below a height position of the discharging roller and includes a placing surface on which the medium discharged by the discharging roller is placed; and a supporting member that is configured to be movable between a retreat position on an upstream side and an advance position on a downstream side in a medium discharging direction between the discharging roller and the placing surface, wherein a friction coefficient of an upper surface of the supporting member is equal to or lower than a friction coefficient of the placing surface, and wherein a position of a downstream end of the supporting member in the medium discharging direction at the advance position is disposed on a downstream side in the medium discharging direction of a position where the downstream end in the medium discharging direction of the medium being discharged in a case in which the supporting member is not present primally comes into contact with an upper surface of the medium precedently placed on the placing surface, the medium contacting with the upper surface of the supporting member while the medium is being discharged on the placing surface.

2. The medium discharging device according to claim 1, wherein an angle between the downstream end of the medium being discharged in a case in which the supporting member is disposed at the advance position and the supporting member at a position where the downstream end primally abuts the upper surface of the supporting member is smaller than an angle between the downstream end of the medium being discharged in a case in which the supporting member is not present at the advance position and the upper surface of the placed medium at a position where the downstream end primally abuts the upper surface of the medium precedently placed on the placing surface.

3. The medium discharging device according to claim 1, wherein the supporting member advances to the advance position when the downstream end of the medium being discharged by the discharging roller is discharged.

4. The medium discharging device according to claim 3, further comprising:

a medium detector that detects the medium being discharged on a downstream of the discharging roller, wherein the supporting member advances to the advance position after the downstream end of the discharged medium is detected by the medium detector.

5. The medium discharging device according to claim 4, wherein the supporting member advances to the advance position after the downstream end of the discharged medium is detected by the medium detector and before the downstream end of the discharged medium comes into contact with an upper surface of the supporting member.

6. The medium discharging device according to claim 1, wherein a position of the downstream end of the supporting member at the retreat position is disposed on an upstream side in the medium discharging direction of a position of an upstream end of the medium in the medium discharging direction which is discharged and dropped to the paper discharging tray.

7. The medium discharging device according to claim 6, wherein the supporting member retreats to the retreat position when the upstream end of the medium discharged by the discharging roller is discharged.

8. The medium discharging device according to claim 7, further comprising:

a medium detector that detects the medium being discharged on a downstream of the discharging roller, wherein the supporting member retreats to the retreat position after the upstream end of the discharged medium is detected by the medium detector.

9. The medium discharging device according to claim 8, wherein the supporting member retreats to the retreat position after the upstream end of the discharged medium is detected by the medium detector and before the discharged medium is dropped to the placing surface.

10. The medium discharging device according to claim 6, wherein the supporting member retreats to the retreat position after the downstream end of the discharged medium starts to move to the downstream side in the medium discharging direction on the supporting member and before the discharged medium is dropped to the placing surface.

11. The medium discharging device according to claim 1, wherein the medium being discharged is a medium bundle in which a plurality of media is bound, and wherein the discharging roller discharges the medium bundle.

12. The medium discharging device according to claim 1, wherein a plurality of the supporting members is disposed in a width direction of the medium, and wherein a height position in a vertical direction where the supporting member disposed near a center of the medium in the width direction advances and retreats is disposed above a height position in a vertical direction where the supporting member disposed near an end portion in the width direction of the medium advances and retreats.

13. The medium discharging device according to claim 12, wherein the supporting member is a sheet member having a sheet shape, and wherein a width of the supporting member disposed near the center of the medium in the width direction is wider than a width of the supporting member disposed near the end portion of the medium.

14. The medium discharging device according to claim 12, wherein the supporting member is a sheet member having a sheet shape, and wherein a thickness of the supporting member disposed near the center of the medium in the width direction is thicker than a thickness of the supporting member disposed near the end portion of the medium.

15. The medium discharging device according to claim 1, further comprising:

a medium surface detector that detects a position of an upper surface of the medium placed on the placing surface, wherein the paper discharging tray is lifted based on the position of the upper surface of the medium detected by the medium surface detector so that the downstream end of the supporting member at the advance position is positioned above the upper surface of the medium placed on the placing surface.

16. The medium discharging device according to claim 1, wherein the medium discharging device is a device discharging the medium from the processing device which discharges liquid to the medium, and wherein the supporting member advances to the advance position in a case in which an amount of the liquid discharged to the medium is equal to or more than a predetermined amount.

* * * * *